US010025231B2

(12) United States Patent
Mizumoto et al.

(10) Patent No.: US 10,025,231 B2
(45) Date of Patent: Jul. 17, 2018

(54) TRANSFER BELT AND IMAGE FORMING DEVICE

(71) Applicant: Konica Minolta, Inc., Chiyoda-ku, Tokyo (JP)

(72) Inventors: Nofumi Mizumoto, Nara (JP); Shigeo Uetake, Takatsuki (JP); Keiko Momotani, Ibaraki (JP); Eiji Tabata, Ibaraki (JP); Makiko Watanabe, Uji (JP); Toshiya Natsuhara, Takarazuka (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/637,482

(22) Filed: Jun. 29, 2017

(65) Prior Publication Data

US 2018/0011429 A1 Jan. 11, 2018

(30) Foreign Application Priority Data

Jul. 5, 2016 (JP) ..... 2016-133309
Jul. 5, 2016 (JP) ..... 2016-133311

(51) Int. Cl.
*G03G 15/16* (2006.01)
*G03G 15/01* (2006.01)
*G03G 15/00* (2006.01)

(52) U.S. Cl.
CPC ..... *G03G 15/1615* (2013.01); *G03G 15/161* (2013.01); *G03G 15/162* (2013.01); (Continued)

(58) Field of Classification Search
CPC ..... G03G 15/1615; G03G 15/162
See application file for complete search history.

(56) References Cited

U.S. PATENT DOCUMENTS 6,389,242 B1 5/2002 Watanabe
2006/0222422 A1 10/2006 Takenaka et al.
(Continued)

FOREIGN PATENT DOCUMENTS

JP 2014-085633 A 5/2014
JP 2014-102384 A 6/2014

OTHER PUBLICATIONS

The extended European Search Report dated Feb. 7, 2018, by the European Patent Office in corresponding European Application No. 17177163.7. (9 pages).

*Primary Examiner* — Sandra Brase
(74) *Attorney, Agent, or Firm* — Buchanan Ingersoll & Rooney PC

(57) ABSTRACT

A transfer belt includes: an elastic layer, wherein the transfer belt is used to transfer a toner image onto a recording medium, the toner image being carried on a first main surface which is one of a pair of main exposed surfaces including the first main surface and a second main surface, when, using a lower block and an upper block, the transfer belt is placed on an upper surface of the lower block, a part of the transfer belt is interposed between a curved convex surface and a curved concave surface, and a pressed region reaches a pressing force of 200 [kPa] and is constantly pressed by the pressing force, if "a" represents a maximum value of displacement of a measurement region, and "b" represents displacement of the measurement region after convergence, E [–] calculated by (a–b)/b satisfies a condition of $0.2 \leq E \leq 3$.

19 Claims, 26 Drawing Sheets

(52) U.S. Cl.
CPC ..... *G03G 15/0189* (2013.01); *G03G 15/167* (2013.01); *G03G 15/6558* (2013.01); *G03G 2215/00751* (2013.01); *G03G 2215/0135* (2013.01)

(56) References Cited

U.S. PATENT DOCUMENTS

| | | | | |
|---|---|---|---|---|
| 2010/0158583 | A1* | 6/2010 | Sakka | G03G 15/162 399/302 |
| 2011/0033213 | A1 | 2/2011 | Nakamura et al. | |
| 2012/0027473 | A1* | 2/2012 | Yamashita | G03G 15/0131 399/308 |
| 2012/0034479 | A1* | 2/2012 | Kimpara | G03G 15/162 428/473.5 |
| 2015/0286167 | A1 | 10/2015 | Omata | |

* cited by examiner

FIG. 16

| | BELT TYPE | EVALUATION RESULTS BY DISPLACEMENT MEASURING DEVICE | | | | | IMAGE FORMING CONDITIONS | | IMAGE FORMING RESULTS | | | | COMPREHENSIVE EVALUATION |
|---|---|---|---|---|---|---|---|---|---|---|---|---|---|
| | | a [μm] | b [μm] | E [−] | k1 [μm/s] | k2 [μm/s] | TRANSFER PRESSURE [kPa] | DIAMETER [mm] OF SECONDARY TRANSFER ROLLER | TRANSFER PROPERTY | IMAGE NOISE | UNIFORMITY IN AXIAL DIRECTION | DROPOUT | |
| EXPERIMENTAL EXAMPLE 1 | A | 10.0 | 5.0 | 1.00 | 180 | 15.0 | 200 | 40 | GOOD | GOOD | GOOD | GOOD | EXCELLENT |
| EXPERIMENTAL EXAMPLE 2 | B | 6.0 | 5.0 | 0.20 | 60 | 6.0 | 200 | 40 | GOOD | GOOD | GOOD | GOOD | EXCELLENT |
| EXPERIMENTAL EXAMPLE 3 | C | 20.0 | 5.0 | 3.00 | 320 | 30.0 | 200 | 40 | GOOD | GOOD | GOOD | GOOD | EXCELLENT |
| EXPERIMENTAL EXAMPLE 4 | D | 8.0 | 4.0 | 1.00 | 180 | 15.0 | 200 | 40 | GOOD | GOOD | GOOD | GOOD | EXCELLENT |
| EXPERIMENTAL EXAMPLE 5 | E | 16.0 | 8.0 | 1.00 | 180 | 15.0 | 200 | 40 | GOOD | GOOD | GOOD | GOOD | EXCELLENT |
| EXPERIMENTAL EXAMPLE 6 | A | 10.0 | 5.0 | 1.00 | 180 | 15.0 | 100 | 40 | GOOD | GOOD | GOOD | GOOD | EXCELLENT |
| EXPERIMENTAL EXAMPLE 7 | A | 10.0 | 5.0 | 1.00 | 180 | 15.0 | 400 | 40 | GOOD | GOOD | GOOD | GOOD | EXCELLENT |
| EXPERIMENTAL EXAMPLE 8 | A | 10.0 | 5.0 | 1.00 | 180 | 15.0 | 200 | 20 | GOOD | GOOD | GOOD | GOOD | EXCELLENT |
| EXPERIMENTAL EXAMPLE 9 | A | 10.0 | 5.0 | 1.00 | 180 | 15.0 | 200 | 60 | GOOD | GOOD | GOOD | GOOD | EXCELLENT |
| EXPERIMENTAL EXAMPLE 10 | A | 10.0 | 5.0 | 1.00 | 180 | 15.0 | 70 | 40 | GOOD | GOOD | ACCEPTABLE | GOOD | GOOD |
| EXPERIMENTAL EXAMPLE 11 | A | 10.0 | 5.0 | 1.00 | 180 | 15.0 | 500 | 40 | GOOD | GOOD | GOOD | ACCEPTABLE | GOOD |
| EXPERIMENTAL EXAMPLE 12 | A | 10.0 | 5.0 | 1.00 | 180 | 15.0 | 200 | 16 | GOOD | GOOD | ACCEPTABLE | GOOD | GOOD |
| EXPERIMENTAL EXAMPLE 13 | A | 10.0 | 5.0 | 1.00 | 180 | 15.0 | 200 | 70 | GOOD | GOOD | GOOD | ACCEPTABLE | GOOD |
| EXPERIMENTAL EXAMPLE 14 | F | 5.8 | 5.0 | 0.15 | 50 | 5.0 | 200 | 40 | BAD | GOOD | GOOD | GOOD | BAD |
| EXPERIMENTAL EXAMPLE 15 | G | 22.5 | 5.0 | 3.50 | 350 | 35.0 | 200 | 40 | GOOD | BAD | GOOD | GOOD | BAD |
| EXPERIMENTAL EXAMPLE 16 | H | 7.0 | 3.5 | 1.00 | 180 | 15.0 | 200 | 40 | ACCEPTABLE | GOOD | GOOD | GOOD | ACCEPTABLE |
| EXPERIMENTAL EXAMPLE 17 | I | 18.0 | 9.0 | 1.00 | 180 | 15.0 | 200 | 40 | GOOD | ACCEPTABLE | GOOD | GOOD | ACCEPTABLE |
| EXPERIMENTAL EXAMPLE 18 | X | 5.0 | 4.4 | 0.14 | 40 | 4.5 | 200 | 40 | BAD | GOOD | GOOD | GOOD | BAD |

FIG. 17

| | BELT TYPE | EVALUATION RESULTS BY DISPLACEMENT MEASURING DEVICE | IMAGE FORMING CONDITIONS | | IMAGE FORMING RESULTS | |
|---|---|---|---|---|---|---|
| | | k2[μm/s] | TRANSFER PRESSURE [kPa] | DIAMETER [mm] OF SECONDARY TRANSFER ROLLER | REPARABILITY OF RECORDING MEDIUM | CLEANING PROPERTY |
| EXPERIMENTAL EXAMPLE 19 | J | 10.0 | 200 | 40 | GOOD | GOOD |
| EXPERIMENTAL EXAMPLE 20 | K | 6.0 | 200 | 40 | ACCEPTABLE | ACCEPTABLE |
| EXPERIMENTAL EXAMPLE 21 | L | 5.0 | 200 | 40 | ACCEPTABLE | ACCEPTABLE |
| EXPERIMENTAL EXAMPLE 22 | M | 3.0 | 200 | 40 | BAD | ACCEPTABLE |
| EXPERIMENTAL EXAMPLE 23 | N | 1.0 | 200 | 40 | BAD | BAD |

| | | CONVEYING SPEED | | |
|---|---|---|---|---|
| | | HIGH SPEED | MEDIUM SPEED | LOW SPEED |
| CONCAVE PORTION DEPTH Δd [μm] | 0 ≤ Δd < 30 | P10 | P20 | P30 |
| | 30 ≤ Δd < 50 | P11 | P21 | P31 |
| | 50 ≤ Δd < 70 | P12 | P22 | P32 |
| | 70 ≤ Δd | P13 | P23 | P33 |

FIG. 29

<PRESSING FORCE SETTING TABLE OF EXAMPLE>

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | 75 [kPa] | 90 [kPa] | 120 [kPa] |
| | 50 ≤ Δd < 70 | 100 [kPa] | 120 [kPa] | 160 [kPa] |
| | 70 ≤ Δd | 125 [kPa] | 150 [kPa] | 200 [kPa] |

FIG. 30

<TRANSFER PROPERTY EVALUATION RESULT OF EXAMPLE>

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | GOOD | GOOD | GOOD |
| | | 15.0 | 13.2 | 11.3 |
| | 50 ≤ Δd < 70 | GOOD | GOOD | GOOD |
| | | 19.2 | 16.9 | 14.7 |
| | 70 ≤ Δd | GOOD | GOOD | GOOD |
| | | 23.4 | 20.7 | 18.5 |

UPPER PORTION: WHETHER TRANSFER PROPERTY IS GOOD OR BAD

LOWER PORTION: INCREASE SPEED [kPa/ms] OF PRESSURE

FIG. 31

<LIFE SPAN EVALUATION RESULT OF EXAMPLE>

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | GOOD | GOOD | GOOD |
| | | 15.0 | 13.2 | 11.3 |
| | 50 ≤ Δd < 70 | GOOD | GOOD | GOOD |
| | | 19.2 | 16.9 | 14.7 |
| | 70 ≤ Δd | GOOD | GOOD | GOOD |
| | | 23.4 | 20.7 | 18.5 |

UPPER PORTION: WHETHER TRANSFER PROPERTY IS GOOD OR BAD

LOWER PORTION: INCREASE SPEED [kPa/ms] OF PRESSURE

FIG. 32

〈 PRESSING FORCE SETTING TABLE OF FIRST COMPARATIVE EXAMPLE 〉

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | 75 [kPa] | 75 [kPa] | 75 [kPa] |
| | 50 ≤ Δd < 70 | 100 [kPa] | 100 [kPa] | 100 [kPa] |
| | 70 ≤ Δd | 125 [kPa] | 125 [kPa] | 125 [kPa] |

FIG. 33

〈TRANSFER PROPERTY EVALUATION RESULT OF FIRST COMPARATIVE EXAMPLE〉

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | GOOD | GOOD | BAD |
| | | 15.0 | 11.3 | 7.5 |
| | 50 ≤ Δd < 70 | GOOD | ACCEPTABLE | BAD |
| | | 19.2 | 14.4 | 9.6 |
| | 70 ≤ Δd | GOOD | ACCEPTABLE | BAD |
| | | 23.4 | 17.5 | 11.7 |

UPPER PORTION: WHETHER TRANSFER PROPERTY IS GOOD OR BAD

LOWER PORTION: INCREASE SPEED [kPa/ms] OF PRESSURE

FIG. 34

〈PRESSING FORCE SETTING TABLE OF SECOND COMPARATIVE EXAMPLE〉

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | 150 [kPa] | 150 [kPa] | 150 [kPa] |
| | 50 ≤ Δd < 70 | 200 [kPa] | 200 [kPa] | 200 [kPa] |
| | 70 ≤ Δd | 250 [kPa] | 250 [kPa] | 250 [kPa] |

FIG. 35

〈TRANSFER PROPERTY EVALUATION RESULT OF SECOND COMPARATIVE EXAMPLE〉

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | GOOD | GOOD | GOOD |
| | | 30.0 | 22.5 | 15.0 |
| | 50 ≤ Δd < 70 | GOOD | GOOD | GOOD |
| | | 38.4 | 28.2 | 19.2 |
| | 70 ≤ Δd | GOOD | GOOD | GOOD |
| | | 46.7 | 35.0 | 23.4 |

UPPER PORTION: WHETHER TRANSFER PROPERTY IS GOOD OR BAD

LOWER PORTION: INCREASE SPEED [kPa/ms] OF PRESSURE

FIG. 36

〈LIFE SPAN EVALUATION RESULT OF SECOND COMPARATIVE EXAMPLE〉

| | | CONVEYING SPEED [mm/s] | | |
|---|---|---|---|---|
| | | 400 | 300 | 200 |
| CONCAVE PORTION DEPTH Δd [μm] | 30 ≤ Δd < 50 | ACCEPTABLE | GOOD | GOOD |
| | | 30.0 | 22.5 | 15.0 |
| | 50 ≤ Δd < 70 | BAD | ACCEPTABLE | GOOD |
| | | 38.4 | 28.2 | 19.2 |
| | 70 ≤ Δd | BAD | ACCEPTABLE | GOOD |
| | | 46.7 | 35.0 | 23.4 |

UPPER PORTION: WHETHER TRANSFER PROPERTY IS GOOD OR BAD

LOWER PORTION: INCREASE SPEED [kPa/ms] OF PRESSURE

FIG. 37

〈RELATION BETWEEN INCREASE SPEED OF PRESSURE AND EACH OF TRANSFER PROPERTY AND LIFE SPAN〉

| | | | INCREASE SPEED ΔP/Δt [kPa/ms] OF PRESSURE | | | | | | | | | | |
|---|---|---|---|---|---|---|---|---|---|---|---|---|---|
| | | | 8 | 10 | 11 | 13 | 15 | 17 | 20 | 25 | 30 | 35 | 38 |
| WHETHER TRANSFER PROPERTY IS GOOD OR BAD | CONCAVE PORTION DEPTH Δd [μm] | 30 ≤ Δd < 50 | BAD | ACCEPTABLE | ACCEPTABLE | GOOD | GOOD | GOOD | GOOD | GOOD | GOOD | GOOD | GOOD |
| | | 50 ≤ Δd < 70 | BAD | BAD | ACCEPTABLE | ACCEPTABLE | GOOD | GOOD | GOOD | GOOD | GOOD | GOOD | GOOD |
| | | 70 ≤ Δd | BAD | BAD | BAD | BAD | ACCEPTABLE | ACCEPTABLE | GOOD | GOOD | GOOD | GOOD | GOOD |
| WHETHER LIFE SPAN IS GOOD OR BAD | | | GOOD | GOOD | GOOD | GOOD | GOOD | GOOD | GOOD | GOOD | ACCEPTABLE | ACCEPTABLE | BAD |
| COMPREHENSIVE EVALUATION | | | BAD | ACCEPTABLE | ACCEPTABLE | ACCEPTABLE | GOOD | GOOD | EXCELLENT | EXCELLENT | GOOD | GOOD | BAD |

TRANSFER BELT AND IMAGE FORMING DEVICE

The entire disclosures of Japanese Patent Application Nos. 2016-133309 and 2016-133311, both filed on Jul. 5, 2016, including description, claims, drawings, and abstract are incorporated herein by reference in its entirety.

BACKGROUND OF THE INVENTION

Field of the Invention

The present invention relates to a transfer belt for transferring a carried toner image onto a recording medium and an image forming device having the same, and more particularly to a transfer belt including at least an elastic layer and an image forming device having the same.

Description of the Related Art

In general, in image forming devices, when a toner image formed on a surface of a photosensitive element is transferred onto a surface of a transfer belt in a primary transfer section, the toner image is carried by the transfer belt, and thereafter, the toner image carried by the transfer belt is transferred onto the recording medium such as a sheet in a secondary transfer section.

Typically, in the secondary transfer section, a predetermined electric field is formed between a secondary transfer roller and the opposite roller constituting a nip section. Due to an action of the electric field, a toner moves from the transfer belt passing through the nip section to the recording medium similarly passing through the nip section, and thus the toner image is transferred onto the recording medium in the secondary transfer section.

Various types of transfer belts have been proposed, but a transfer belt including an elastic layer is known as a transfer belt that enables transfer onto a recording medium having concave-convex portions on a recording surface (that is, an embossed sheet or the like). For example, JP 2014-85633 A and JP 2014-102384 A disclose a transfer belt in which an elastic layer made of acrylic rubber or the like is formed on a base layer serving as an anelastic layer made of polyimide or the like.

If the transfer belt including such an elastic layer is used, when the transfer belt is pressed toward the recording medium in the nip section of the secondary transfer section, deformation occurs so that a part of the transfer belt on the surface side sinks to the concave portion positioned on the surface of the recording medium, and thus a distance between the bottom surface of the concave portion of the recording medium and the surface of the transfer belt is reduced. Accordingly, the action of the electric field is promoted, the movement of toner easily occurs, and a transfer property onto the recording medium having the concave-convex portions formed on the recording surface is improved.

Here, even when the transfer belt including the elastic layer is used as described above, in order to implement a high transfer property for a recording medium having a deeper concave portion on its surface, it is desirable that it be necessary to further increase a thickness of the elastic layer formed on the transfer belt or further decrease a hardness of the elastic layer.

However, in the above-described configuration, the transfer belt cracks or abraded at an early stage due to the repetitive use, and a problem in that an image grade significantly deteriorates separately occurs accordingly. For this reason, it is unable to increase the thickness of the elastic layer or reduce the hardness of the elastic layer unnecessarily, and there is a limitation to improving the transfer property.

SUMMARY OF THE INVENTION

In this regard, the present invention has been made to solve the above-mentioned problems, and it is an object of the present invention to provide a transfer belt which is capable of implementing a high transfer property even for a recording medium having concave-convex portions on the surface and suppressing degradation in an image grade by repetitive use and an image forming device having the same.

The inventors of the preset invention have fabricated various belts including an elastic layer and conducted researches on them, and accordingly found that the transfer property was dramatically improved when a belt in which a surface is displaced while illustrating a predetermined characteristic behavior when pressing is performed under a predetermined pressing condition is used as a transfer belt, leading to completion of the present invention. Here, it is possible to evaluate whether or not it is a belt in which a surface is displaced while illustrating a predetermined characteristic behavior when pressing is performed under a predetermined pressing condition through an evaluation method using a displacement measuring device to be described later which was devised by the inventors of the present invention.

To achieve the abovementioned object, according to an aspect, a transfer belt reflecting one aspect of the present invention comprises: at least an elastic layer, wherein the transfer belt is used to transfer a toner image onto a recording medium, the toner image being carried on a first main surface which is one of a pair of main exposed surfaces including the first main surface and a second main surface being positioned to face each other, when, using a lower block including a curved convex surface having a width of 20 [mm] and a curvature radius of 20 [mm] as an upper surface and a hole section having a diameter of 1.25 [mm] formed at an apex of the curved convex surface and an upper block including a curved concave surface having a width of 20 [mm] and a curvature radius of 20.3 [mm] as a lower surface, the transfer belt is placed on the upper surface of the lower block so that the first main surface faces the upper surface of the lower block, a part of the transfer belt is interposed between the curved convex surface and the curved concave surface by moving down the upper block toward the lower block, and a pressed region which is the part of the transfer belt reaches a pressing force of 200 [kPa] at a pressing speed of 4 [kPa/ms] and then is constantly pressed by a pressing force of 200 [kPa], if a maximum value of displacement of a measurement region which is a portion of the first main surface corresponding to the hole section is indicated by "a" [μm], and displacement of the measurement region after the displacement of the measurement region converges is indicated by "b" [μm], E [−] calculated by (a−b)/b using "a" and "b" satisfies a condition of $0.2 \leq E \leq 3$.

According to the transfer belt of the aspect of the present invention, "b" preferably further satisfies a condition of $4 \leq b \leq 8$.

According to the transfer belt of the aspect of the present invention, when a period of time from a point in time at which pressing against the pressed region starts to a point in time at which the maximum value of the displacement of the measurement region is observed is indicated by t1 [s], and a period of time from the point in time at which the pressing against the pressed region starts to a point in time at which the displacement of the measurement region reaches (a+b)/2 again after the maximum value of the displacement of the measurement region is observed is indicated by t2 [s], k2 [μm/s] calculated by (a−b)/{2×(t2−t1)} using "a," "b," "t1," and "t2" preferably further satisfies a condition of 6≤k2≤30.

To achieve the abovementioned object, according to an aspect, a transfer belt reflecting one aspect of the present invention comprises: at least an elastic layer, wherein the transfer belt is used to transfer a toner image onto a recording medium, the toner image being carried on a first main surface which is one of a pair of main exposed surfaces including the first main surface and a second main surface being positioned to face each other, when, using a lower block including a curved convex surface having a width of 20 [mm] and a curvature radius of 20 [mm] as an upper surface and a hole section having a diameter of 1.25 [mm] formed at an apex of the curved convex surface and an upper block including a curved concave surface having a width of 20 [mm] and a curvature radius of 20.3 [mm] as a lower surface, the transfer belt is placed on the upper surface of the lower block so that the first main surface faces the upper surface of the lower block, a part of the transfer belt is interposed between the curved convex surface and the curved concave surface by moving down the upper block toward the lower block, and a pressed region which is the part of the transfer belt reaches a pressing force of 200 [kPa] at a pressing speed of 4 [kPa/ms] and then is constantly pressed by a pressing force of 200 [kPa], if a maximum value of displacement of a measurement region which is a portion of the first main surface corresponding to the hole section is indicated by "a" [μm], and a period of time from a point in time at which pressing against the pressed region starts to a point in time at which the maximum value of the displacement of the measurement region is observed is indicated by t1 [s], k1 [μm/s] calculated by a/t1 using "a" and "k1" satisfies a condition of 60≤k1≤320.

According to the transfer belt of the aspect of the present invention, when displacement of the measurement region after the displacement of the measurement region converges is indicated by "b" [μm], "b" preferably satisfies a condition of 4≤b≤8.

According to the transfer belt of the aspect of the present invention, when displacement of the measurement region after the displacement of the measurement region converges is indicated by "b" [μm], and a period of time from the point in time at which the pressing against the pressed region starts to a point in time at which the displacement of the measurement region reaches (a+b)/2 again after the maximum value of the displacement of the measurement region is observed is indicated by t2 [s], k2 [μm/s] calculated by (a−b)/{2×(t2×t1)} using "a," "b," "t1," and "t2" preferably further satisfies a condition of 6≤k2≤30.

According to the transfer belt of the aspect of the present invention, the transfer belt preferably further comprises: a base layer and a surface layer in addition to the elastic layer, wherein the elastic layer is preferably formed to cover the base layer, the surface layer is preferably further formed to cover the elastic layer, and the first main surface is preferably defined by the surface layer.

To achieve the abovementioned object, according to an aspect, an image forming device reflecting one aspect of the present invention comprises: an image carrier and an intermediate transfer belt each of which carries a toner image; a primary transfer section that transfers the toner image carried on the image carrier onto the intermediate transfer belt; and a secondary transfer section that transfers the toner image carried on the intermediate transfer belt onto a recording medium, wherein the secondary transfer section includes a secondary transfer roller, an opposite roller opposed to the secondary transfer roller, and a nip section formed by the secondary transfer roller and the opposite roller, the intermediate transfer belt is arranged to pass through the nip section, and the transfer belt is used as the intermediate transfer belt.

According to the image forming device of the aspect of the present invention, the first main surface of the intermediate transfer belt is preferably arranged to face the secondary transfer roller side, and hardness of a surface of the secondary transfer roller is preferably higher than hardness of a surface of the opposite roller.

According to the image forming device of the aspect of the present invention, the secondary transfer roller preferably has a diameter of 20 [mm] to 60 [mm].

According to the image forming device of the aspect of the present invention, maximum pressure in the nip section is preferably 100 [kPa] or more and 400 [kPa] or less.

To achieve the abovementioned object, according to an aspect, an image forming device reflecting one aspect of the present invention comprises: the transfer belt according to the aspect of the present invention; a transfer section that pinches and presses the transfer belt and a recording medium and transfers a toner image carried on the transfer belt onto the recording medium; a fixing section that fixes the toner image transferred onto the recording medium onto the recording medium; a conveying mechanism that conveys the recording medium from the transfer section to the fixing section; a recording medium type information acquiring unit that acquires a recording medium type conveyed by the conveying mechanism; a conveying speed setting unit that variably sets a conveying speed of the recording medium by the conveying mechanism; a pressing force changing mechanism that changes pressing force to be applied to the transfer belt and the recording medium in the transfer section; and a control section that controls an operation of the pressing force changing mechanism such that the pressing force is adjusted in accordance with the recording medium type acquired by the recording medium type information acquiring unit and the conveying speed of the recording medium set by the conveying speed setting unit.

According to the image forming device of the aspect of the present invention, the recording medium type information acquiring unit preferably acquires the recording medium type on the basis of a concave portion depth of a surface of a recording medium.

According to the image forming device of the aspect of the present invention, the control section preferably controls the operation of the pressing force changing mechanism such that the pressing force increases as the conveying speed of the recording medium decreases.

According to the image forming device of the aspect of the present invention, the image forming device preferably further comprises: a plurality of pressing force setting tables in which a relation between the recording medium type and the pressing force is decided in advance for each conveying speed, wherein the control section preferably decides the pressing force with reference to the pressing force setting table according to the conveying speed from the plurality of pressing force setting tables.

According to the image forming device of the aspect of the present invention, the image forming device preferably further comprises: a plurality of pressing force setting tables in which a relation between the conveying speed and the pressing force is decided in advance for each recording medium type, wherein the control section preferably decides the pressing force with reference to the pressing force setting table according to the recording medium type from the plurality of pressing force setting tables.

According to the image forming device of the aspect of the present invention, when the conveying speed is indicated by Vsys [mm/s], a maximum value of the pressing force is P [kPa], a width of a nip section of the transfer section is indicated by W [mm], an increase speed $\Delta P/\Delta t$ [kPa/ms] of pressure in the nip section is indicated by $\Delta P/\Delta t=(P/2)\times Vsys/(W/2)\times 1000$, $\Delta P/\Delta t$ preferably satisfies $10\leq\Delta P/\Delta t\leq 35$.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 16 is a table illustrating an image forming condition and an image forming result of an experiment of confirming performance;

FIG. 17 is a table illustrating an image forming condition and an image forming result of an additional experiment;

FIG. 29 is a view illustrating a specific example of a pressing force setting table used in an example;

FIG. 30 is a table illustrating image evaluation results and measured values of an increase speed of pressure in an example;

FIG. 31 is a table illustrating a result of confirming a life span of an intermediate transfer belt and measured values of an increase speed of pressure according to an example;

FIG. 32 is a view illustrating a specific example of a pressing force setting table used in a first comparative example;

FIG. 33 is a table illustrating image evaluation results and measured values of an increase speed of pressure in the first comparative example;

FIG. 34 is a view illustrating a specific example of a pressing force setting table used in a second comparative example;

FIG. 35 is a table illustrating image evaluation results and measured values of an increase speed of pressure in the second comparative example;

FIG. 36 is a table illustrating a result of confirming a life span of an intermediate transfer belt and measured values of an increase speed of pressure in the second comparative example; and FIG. 37 is a table illustrating a relation between an increase speed of pressure and each of a transfer property and a life span.

DESCRIPTION OF THE PREFERRED EMBODIMENTS

Figure 1:
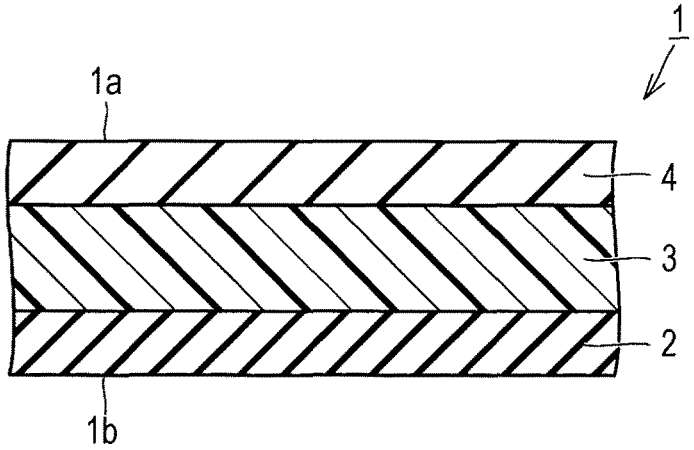
FIG. 1 is a cross-sectional view of a transfer belt according to an embodiment of the present invention.

Hereinafter, an embodiment of the present invention will be described in detail with reference to the drawings. However, the scope of the invention is not limited to the illustrated examples. In the following embodiment, the same or common parts are denoted by the same reference numerals in the drawings, and description thereof will not be repeated.

<Transfer Belt>

FIG. 1 is a cross-sectional view of a transfer belt according to an embodiment of the present invention. First, a configuration of a transfer belt 1 according to the present embodiment will be described with reference to FIG. 1.

The transfer belt 1 is configured with a member including a first main surface 1*a* and a second main surface 1*b* which are a pair of main exposed surfaces positioned to face each other, and includes a base layer 2, an elastic layer 3, and a surface layer 4 as illustrated in FIG. 1.

The elastic layer 3 is formed to cover the base layer 2, and the surface layer 4 is formed to cover the elastic layer 3. Thus, the first main surface 1*a* is specified by the surface layer 4, and the above-described second main surface 1*b* is specified by the base layer 2.

The transfer belt 1 functions to transfer a carried toner image onto a recording medium in, for example, an electrophotography image forming device or the like, and the toner image is carried on the first main surface 1*a*. A specific example of installation of the transfer belt 1 in the image forming device will be described later.

The base layer 2 is a layer for improving a mechanical strength of the transfer belt 1 as a whole and is configured with, for example, a layer configured with an organic polymer compound. Examples of the organic polymer compound constituting the base layer 2 include polycarbonate, fluorine-based resin, styrene-based resins (homopolymers or copolymers containing styrene or styrene substitution) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylic acid ester copolymer (styrene-acrylic acid methyl copolymer, styrene-acrylic acid ethyl copolymer, styrene-butyl acrylate copolymer, styrene-acrylic acid octyl copolymer and styrene-acrylic acid phenyl copolymer, or the like), styrene-methacrylic acid ester copolymer (styrene-methyl methacrylate copolymer, styrene-methacrylic acid ethyl copolymer, styrene-methacrylic acid phenyl copolymer, or the like), styrene-α-chloroacrylic acid methyl copolymer, or styrene-acrylonitrile-acrylic acid ester copolymer, methyl methacrylate resin, methacrylic acid butyl resin, ethyl acrylate resin, butyl acrylate resin, modified acrylic resin (silicone modified acrylic resin, vinyl chloride resin modified acyl resin, acrylic urethane resin, or the like), vinyl chloride resin, styrene-vinyl acetate copolymer, vinyl chloride-vinyl acetate copolymer, rosin modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin and polyvinyl butyral resin, polyamide resin, polyimide resin, modified polyphenylene oxide resin, modified polycarbonate, and a mixtures thereof. Further, the base layer 2 may be configured by a plurality of layers made of different materials.

A conducting agent for adjusting a resistance value may be added to the base layer 2. As the conducting agent, only one type may be added, or plural types may be added. Content of the conducting agent in the base layer 2 is preferably 0.1 part by weight or more and 20 parts by weight or less with respect to 100 parts by weight of a base layer material, but the present invention is not limited thereto.

The elastic layer 3 is a layer for imparting elasticity to the transfer belt 1 and is configured with, for example, a layer made of an organic compound showing viscoelasticity. Examples of the organic compound constituting the elastic layer 3 include butyl rubber, fluorine-based rubber, acrylic rubber, ethylene propylene rubber (EPDM), nitrile butadiene rubber (NBR), acrylonitrile butadiene styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluororubber, polysulfide rubber, polynorbornene rubber, hydrogenated nitrile rubber, thermoplastic elastomers (for example, polystyrene-based, polyolefin-based, polyvinyl chloride-based, polyurethane-based, polyamide-based, polyurea, polyester-based, or fluororesin-based), and a mixtures thereof. Further, the elastic layer 3 may be configured with a plurality of layers having different materials.

A conducting agent for implementing conductivity may be added to the elastic layer 3. As the conducting agent, only one type may be added, or plural types may be added. Content of the conducting agent in the elastic layer 3 is preferably 0.1 part by weight or more and 30 parts by weight or less with respect to 100 parts by weight of an elastic layer material, but the present invention is not limited thereto. Content of the conducting agent in the elastic layer 3 is an amount for implementing desired volume resistivity of the transfer belt 1 in the total amount, and the volume resistivity of the transfer belt 1 is, for example, 108 [Ω·cm] or more and 1012 [Ω·cm] or less.

The conducting agent includes an ion conducting agent and an electron conducting agent. Examples of ion conducting agent include silver iodide, copper iodide, lithium perchlorate, lithium perchlorate, lithium perchlorate, lithium trifluoromethanesulfonate, lithium salt of organoboron complex, lithium bisimide ($(CF_3SO_2)_2NLi$), and lithium trismethide ($(CF_3SO_2)_3CLi$). Examples of the electron conducting agent include metals such as silver, copper, aluminum, magnesium, nickel and stainless steel and a carbon compound such as graphite, carbon black, carbon nanofiber, and carbon nanotube.

In addition to the above-mentioned conducting agents, non-fiber shaped resin or fiber shaped resin may be contained in the elastic layer 3.

As the non-fiber shaped resin, thermosetting resin such as phenol resin, thermosetting urethane resin, epoxy resin, or a reactive monomer and thermoplastic resin such as polyvinyl chloride, polyvinyl acetate, or thermoplastic urethane may be used. Content of the non-fiber shaped resin in the elastic layer 3 with respect to the elastic layer material is preferably 20 parts by weight or more and 60 parts by weight or less with respect to 100 parts by weight of the elastic layer material, but the present invention is limited thereto.

As the fiber-shaped resin, for example, resin-based fibers such as cotton, hemp, silk, rayon, acetate, nylon, acrylic, vinylon, vinylidene, polyester, polystyrene, polypropylene, or aramid may be used. Content of the fiber-shaped resin in the elastic layer 3 is preferably 10 parts by weight or more and 40 parts by weight or less with respect to 100 parts by weight of the elastic layer material, but the present invention is not limited thereto.

A commonly used additive such as a vulcanizing agent, a vulcanization accelerator, a vulcanization aid, a co-crosslinking agent, a softener, or a plasticizer may be contained in the elastic layer 3. Only one of the additives may be added, or a combination of two or more types of additives may be added.

For example, sulfur, an organic sulfur-containing compound, or organic peroxide may be used as the vulcanizing agent.

Further, as the co-crosslinking agent, a co-crosslinking agent by organic peroxide such as ethylene glycol dimethacrylate, trimethylolpropane trimethacrylate, polyfunctional methacrylate monomer, triallyl isocyanurate, or metal-containing monomers may be used. An addition amount of the co-crosslinking agent in the elastic layer 3 is preferably 5 parts by weight or less with respect to 100 parts by weight of the elastic layer material, but the present invention is not limited thereto.

A material of the surface layer 4 is not particularly limited, and it is desirable to increase the transfer property by reducing adhesion force of the toner to the transfer belt 1. From this point of view, as the surface layer 4, for example, a layer in which polyurethane, polyester, epoxy resin, or a mixture thereof is used as a base material, and one or more types of powders or particles of fluororesin, a fluorine compound, fluorocarbon, titanium dioxide, silicon carbide are dispersed in the base material may be used. The surface layer 4 may be a layer obtained by performing modification treatment on the surface of the elastic layer 3.

Here, the powders and the particles are materials for increasing the lubricity by decreasing the surface energy of the first main surface 1*a*, and a layer in which the powders or the particles having different particle sizes are dispersed may be used. Further, the surface energy of the first main surface 1*a* may be decreased by forming a fluorine-rich layer on the surface by performing heat treatment using a fluorine-based rubber material.

Further, the surface layer 4 need not be necessarily formed, and the transfer belt 1 may be configured only with the base layer 2 and the elastic layer 3. Alternatively, the transfer belt 1 may be configured only with the elastic layer 3 without forming the base layer 2. Further, the transfer belt 1 including four or more layers may be formed by adding another layer in addition to the base layer 2, the elastic layer 3, and the surface layer 4.

A ten-point average surface roughness Rz of the first main surface 1*a* in the transfer belt 1 is preferably 0.5 [μm] or more and 9.0 [μm] or less, more preferably 3.0 [μm] or more and 6.0 [μm] or less. When the ten-point average surface roughness Rz is less than 0.5 [μm], it is likely to come into close contact with a contact member, and when the ten-point average surface roughness Rz is larger than 9.0 [μm], the toner or sheet powders are likely to be accumulated in the concave-convex portions, and the image quality is likely to degrade. The ten-point average surface roughness Rz refers to surface roughness specified in JIS B 0601 (2001).

Here, the transfer belt 1 according to the present embodiment is a transfer belt in which a part of the surface (that is, the first main surface 1*a*) is displaced while showing a predetermined characteristic behavior when evaluated based on an evaluation method using a displacement measuring device which will be described later, and detailed description will be given later.

<Use Example of Transfer Belt>

Figure 2:
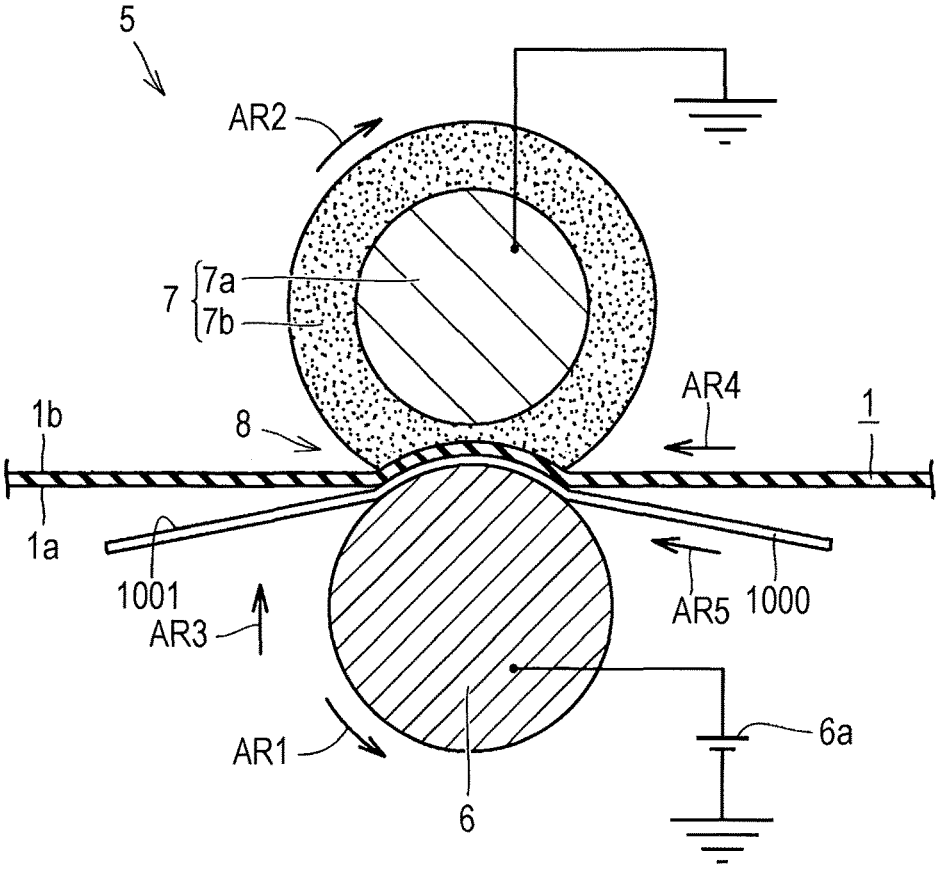
FIG. 2 is a schematic view of a secondary transfer section for describing a use example of the transfer belt illustrated in FIG. 1.

FIG. 2 is a schematic view of the secondary transfer section for describing a use example of the transfer belt illustrated in FIG. 1. Next, a use example of the transfer belt 1 according to the present embodiment will be described with reference to FIG. 2. The use of transfer belt 1 according to the present embodiment is not limited to this use example.

The use example of the transfer belt 1 illustrated in FIG. 2 illustrates a specific example in which the transfer belt 1 is installed in an electrophotography image forming device. In this case, the transfer belt 1 is arranged to pass through a secondary transfer section 5 of the image forming device.

The secondary transfer section 5 includes a secondary transfer roller 6 and an opposite roller 7 which are arranged in parallel to face each other. A nip section 8 is formed between the secondary transfer roller 6 and the opposite roller 7. The transfer belt 1 is arranged to pass through the nip section 8, and a recording medium 1000 is supplied to pass through the nip section 8 as well.

The secondary transfer roller 6 is made of a conductive material, and a secondary transfer power source 6*a* is connected to the secondary transfer roller 6. The opposite roller 7 includes a cored bar 7*a* made of a conductive material and an elastic portion 7*b* with conductivity covering a circumferential surface of the cored bar 7*a*, and the cored bar 7*a* is grounded. Accordingly, a predetermined electric field is formed in the nip section 8 by the secondary transfer roller 6, the opposite roller 7, and the secondary transfer power source 6*a*.

The transfer belt 1 is arranged to be inserted and pass through the opposite roller 7 side further than the recording medium 1000, and the recording medium 1000 is supplied to pass through the secondary transfer roller 6 side further than the transfer belt 1. The transfer belt 1 is arranged such that the first main surface 1*a* faces the recording medium 1000 side (that is, the secondary transfer roller 6 side), and the second main surface 1*b* faces the opposite roller 7 side. Accordingly, the first main surface 1*a* of the transfer belt 1 is arranged to face a recording surface 1001 of the recording medium 1000 in the nip section 8.

The secondary transfer roller 6 is rotationally driven in a direction of an arrow AR1 illustrated in FIG. 2, and the opposite roller 7 is rotationally driven in a direction of an arrow AR2 illustrated in FIG. 2. Further, when the toner image is transferred, the secondary transfer roller 6 is pressed by a pressing mechanism (not illustrated) in a direction of an arrow AR3 illustrated in FIG. 2, and thus the secondary transfer roller 6 and the opposite roller 7 come into press-contact with each other with the transfer belt 1 and the recording medium 1000 interposed therebetween.

On the basis of the rotation of the secondary transfer roller 6 and the rotation of the opposite roller 7, the transfer belt 1 and the recording medium 1000 are conveyed in a direction of an arrow AR4 and a direction of an arrow AR5 illustrated in FIG. 2. At this time, when passing through the nip section 8, the transfer belt 1 and the recording medium 1000 are pinched and brought into close contact with each other in a state in which they are pressed by the secondary transfer roller 6 and the opposite roller 7. At that time, the above-mentioned predetermined electric field acts on the transfer belt 1 and the recording medium 1000 which are brought into close contact with each other. Accordingly, the toner adhered to the first main surface 1*a* of the transfer belt 1 is attached to the recording surface 1001 of the recording medium 1000, so that the toner image is transferred.

Here, since the hardness of the surface of the secondary transfer roller 6 is higher than the hardness of the surface of the opposite roller 7, the transfer belt 1 and the recording medium 1000 pinched between the secondary transfer roller 6 and the opposite roller 7 are curved along the surface of the secondary transfer roller 6. Therefore, on the first main surface 1*a* of the transfer belt 1, a concave line-like curved surface extending along an axial direction of the secondary transfer roller 6 is formed, and the transfer of the toner image transfer is performed at this portion.

The transfer belt 1 according to the present embodiment is not limited to the example in which a plain sheet having no particular concave-convex portions on its surface or the like is used as the recording medium 1000, and even when an embossed sheet having concave-convex portions on its surface or the like is used, an excellent transfer property can be secured, but a mechanism thereof and the like will be described later, and the evaluation method using the displacement measuring device will be described below in detail.

<Displacement Measuring Device>

Figure 3A:
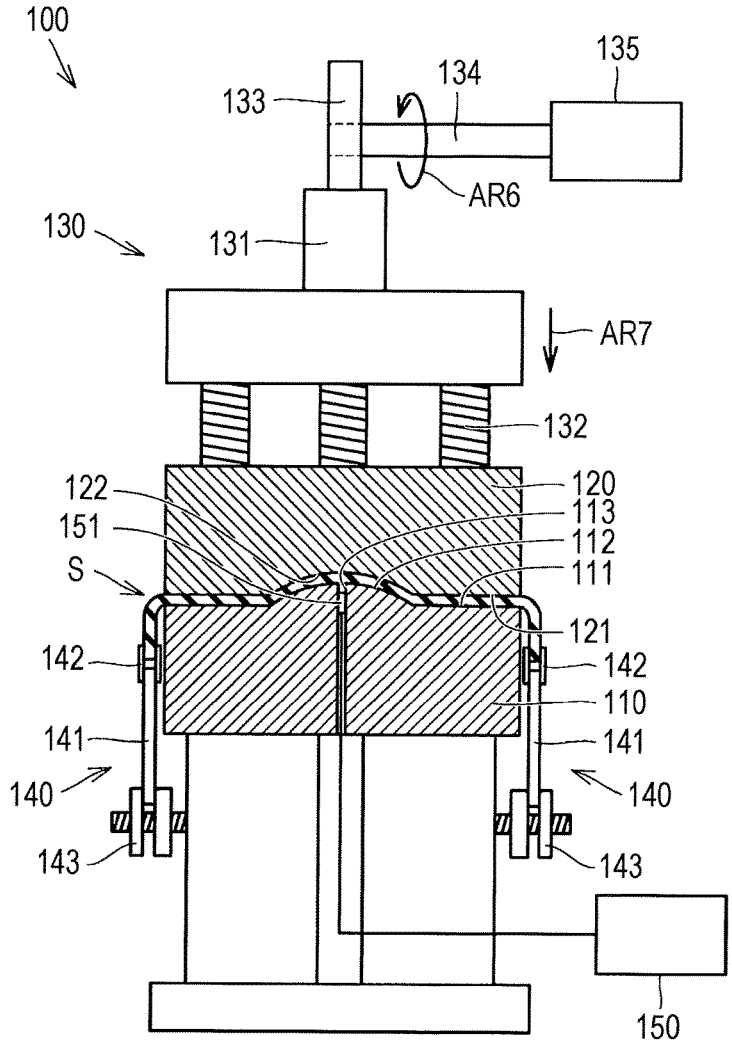
FIGS. 3A to 3C are schematic views illustrating a configuration of a displacement measuring device and an action of a pressing mechanism included in the displacement measuring device.
Figure 3B:
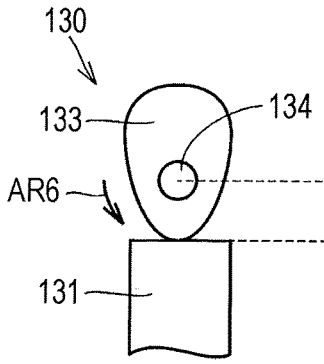
Figure 3C:
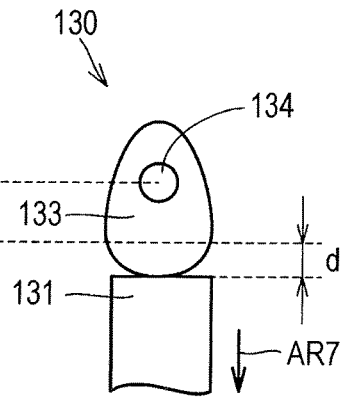
Figure 4A:
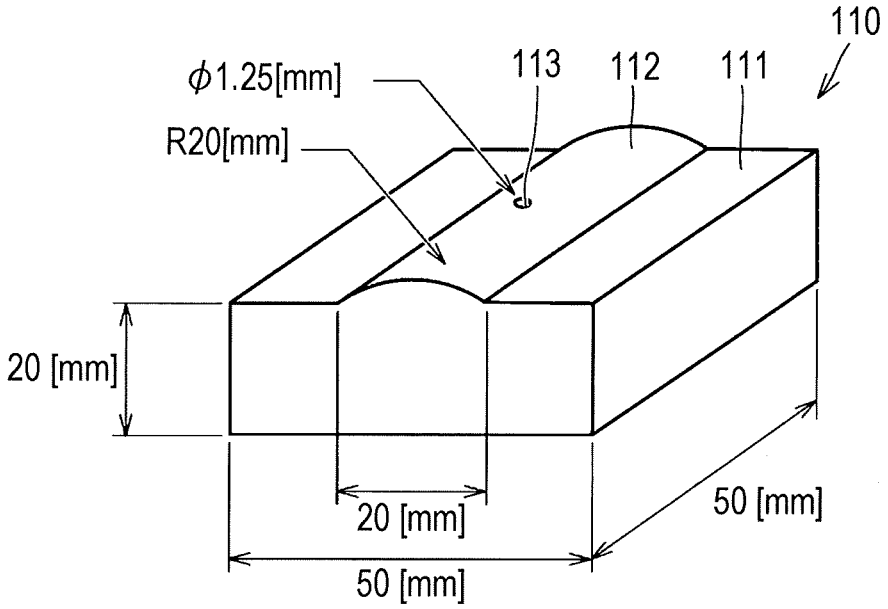
FIGS. 4A and 4B are perspective views of a lower block and an upper block of the displacement measuring device illustrated in FIG. 3A.
Figure 4B:
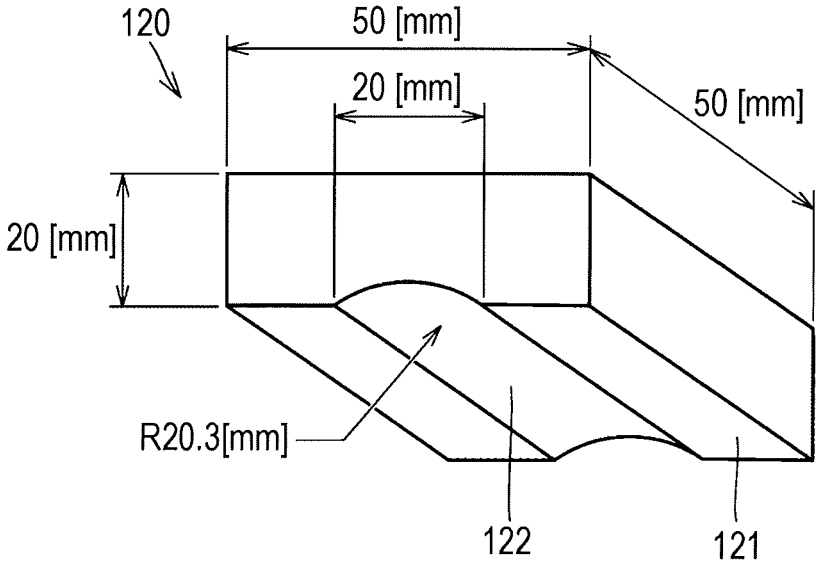

FIG. 3A is a schematic view illustrating a configuration of the displacement measuring device, and FIGS. 3B and 3C are views illustrating an operation of the pressing mechanism installed in the displacement measuring device. FIG. 4A is a perspective top view of a lower block of the displacement measuring device illustrated in FIG. 3A, and FIG. 4B is a perspective bottom view of an upper block of the displacement measuring device illustrated in FIG. 3A.

A displacement measuring device 100 mainly includes a lower block 110, an upper block 120, a pressing mechanism 130, a tensile force applying mechanism 140, and a displacement gage 150 as illustrated in FIG. 3A.

The lower block 110 is made of an aluminum block in which both a width and a depth are 50 [mm], and a height is 20 [mm], and includes a curved convex surface 112 with a width of 20 [mm] at the center of an upper surface 111 in a width direction as illustrated in FIGS. 3A and 4A. A curvature radius of the curved convex surface 112 is 20 [mm].

A hole section 113 having a diameter of 1.25 [mm] (here, a tolerance is ±0.02 [mm]) is formed at a center of an apex of the curved convex surface 112 positioned along the depth direction of the lower block 110 in the depth direction. A head section 151 of the displacement gage 150 is arranged at a position retreated from an opening plane of the hole section 113.

The upper block 120 is made of an aluminum block in which both a width and a depth are 50 [mm], and a height is 20 [mm], and includes a curved concave surface 122 with a width of 20 [mm] at the center of a lower surface 121 in the width direction as illustrated in FIGS. 3A and 4B. The curvature radius of the curved concave surface 122 is 20.3 [mm].

Both a tolerance of the upper surface 111 and the curved convex surface 112 of the lower block 110 and a tolerance of the lower surface 121 and the surface of the curved concave surface 122 of the upper block 120 are 0.02 [mm].

The upper surface 111 of the lower block 110 and the lower surface 121 of the upper block 120 are arranged to face each other as illustrated in FIG. 3A. Here, since the lower block 110 and the upper block 120 are positioned and arranged, the curved convex surface 112 and the curved concave surface 122 are arranged to overlap with each other along a vertical direction.

The pressing mechanism 130 is arranged above the upper block 120. The pressing mechanism 130 includes a pressing member 131 which is a block-like member, a spring 132 arranged between the pressing member 131 and the upper block 120, a cam 133 arranged to come into contact with the upper surface of the pressing member 131, a shaft 134 coupled to the cam 133, and a drive motor 135 that rotationally drives the shaft 134.

As the shaft 134 is rotationally driven by the drive motor 135 in a direction of an arrow AR6 illustrated in FIG. 3B, the cam 133 coupled to the shaft 134 co-rotates together with the shaft 134, and the pressing member 131 is pushed downward (in a direction of an arrow AR7 illustrated in FIG. 3C) in accordance with the co-rotation as illustrated in FIGS. 3B and 3C. Accordingly, the pressing member 131 pushes down the upper block 120 via the spring 132, and a vertical downward load is applied to the upper block 120. A magnitude of the load is decided in accordance with a downward pressing amount d of the pressing member 131, and the downward pressing amount d of the pressing member 131 can be adjusted by the rotation amount of the cam 133.

A belt S serving as an evaluation target is arranged between the lower block 110 and the upper block 120, and both ends of the belt S are pulled outward from between the lower block 110 and the upper block 120 as illustrated in FIG. 3A. The tensile force applying mechanism 140 is coupled to both ends of the belt S.

The tensile force applying mechanism 140 includes a film 141, a tape 142, and a spindle 143. The film 141 is made of a polyethylene terephthalate film having a thickness of 100 [μm], and the tape 142 is made of a polyimide adhesive tape having a thickness of 30 [μm]. One end of the film 141 is attached to the end of the belt S by the tape 142, and a spindle 143 is attached to the other end of the film 141. Here, a tensile load by the spindle 143 is adjusted to 44 [N/m]. Further, when the belt S to be evaluated has a sufficient size, the spindle 143 may be directly attached to both ends of the belt S without using the film 141 and the tape 142.

The displacement gage 150 functions to detect displacement of the surface of the belt S, and as described above, the head section 151 of the displacement gage 150 is installed in the hole section 113 of the lower block 110 to face the belt S. Here, a micro-head spectral-interference laser displacement meter (spectroscopy unit (model: SI-F01U)) and a head section (model: SI-F01) available from Keyence Corporation are used as the displacement gage 150.

<Evaluation Method>

Figure 5:
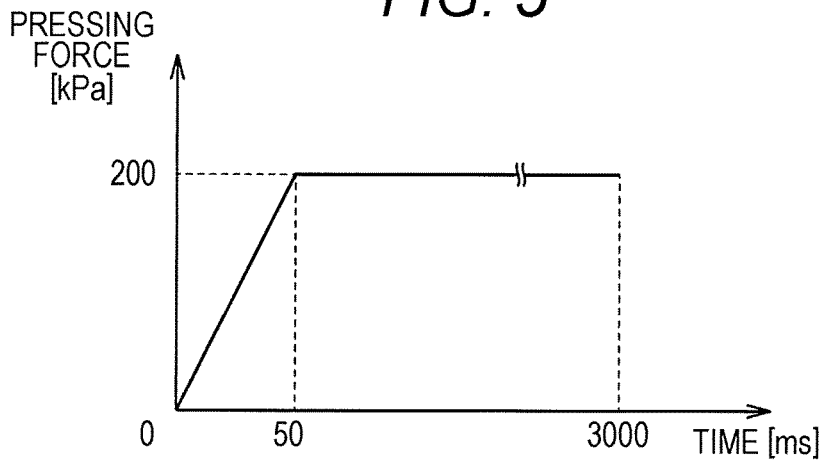
FIG. 5 is a graph for describing a belt evaluation method using the displacement measuring device illustrated in FIG. 3A.
Figure 6:
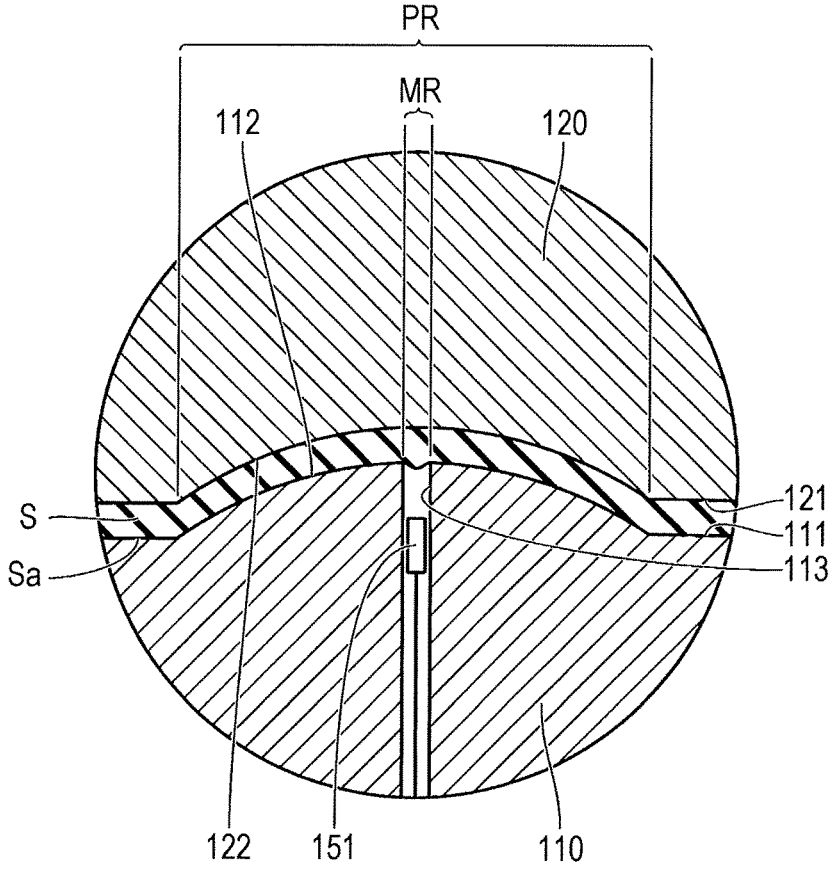
FIG. 6 is an enlarged cross-sectional view illustrating a portion near a hole section of the lower block in a state in which a belt is pressed using the displacement measuring device illustrated in FIG. 3A.

FIG. 5 is a graph for describing a belt evaluation method using the displacement measuring device illustrated in FIG. 3A. FIG. 6 is an enlarged cross-sectional view illustrating a portion near the hole section of the lower block in a state in which the belt is pressed using the displacement measuring device illustrated in FIG. 3A.

The belt S is evaluated by the following procedure using the displacement measuring device 100 illustrated in FIG. 3A. The evaluation is performed in an environment in which temperature is 20 [° C.], and humidity is 50[%].

First, before the belt S is set in the displacement measuring device 100, pressure distribution at a contact portion between the curved convex surface 112 of the lower block 110 and the curved concave surface 122 of the upper block 120 is measured. The pressure distribution is measured using a tactile sensor (a surface pressure distribution measurement system I-SCAN) available from Nitta Corporation.

Specifically, a measurement portion of the tactile sensor is inserted between the lower block 110 and the upper block 120, and the pressing member 131 is depressed downward to measure the pressure distribution after 30 seconds elapse. This is repeated to perform an adjustment so that the pressure at the contact portion between the curved convex surface 112 and the curved concave surface 122 and a portion near the contact portion fall within 200 [kPa]±40 [kPa].

The belt S is stored for 6 hours or more in an environment in which temperature is 20 [° C.], and humidity is 50[%] prior to the measurement. As a size of the belt S to be evaluated, a length corresponding to the width direction of the lower block 110 and the upper block 120 is set to 60 [mm], and a length corresponding to the depth direction of the lower block 110 and the upper block 120 is set to 50 [mm]. A length corresponding to the width direction of the lower block 110 and the upper block 120 may be a size of 35 [mm] or more and 300 [mm] or less, and a length corresponding to the depth direction of the lower block 110 and the upper block 120 may be 50 [mm] or more and 150 [mm] or less. When the length corresponding to the width direction of the lower block 110 and the upper block 120 is insufficient, it is desirable that the spindle 143 be attached to both ends thereof using the film 141 and the tape 142.

Then, the tactile sensor is removed, the upper block 120 is moved down by the pressing mechanism 130 so that the lower block 110 and the upper block 120 are brought into light contact with each other, and thereafter this state is maintained for 30 seconds to stabilize the contact state. Thereafter, the upper block 120 is pressed toward the lower block 110 using the pressing mechanism 130. Here, a pressing condition is the same as a pressing condition of the belt S described later (For the details, see the pressing condition of the belt S to be described later.)

Then, a position of a portion of the curved concave surface 122 of the upper block 120 facing the hole section 113 of the lower block 110 is measured for 3 seconds from a pressurization start time using the displacement gage 150, and this is set as a base line for the displacement measurement of the belt S described later.

Then, the upper block 120 is moved up to release the contact between the lower block 110 and the upper block 120, and the belt S is arranged on the upper surface 111 of the lower block 110. At this time, a first main surface Sa of the belt S faces downward (that is, the lower block 110 side). When the belt S is placed, foreign substances should not be mixed into between the belt S and the lower block 110 and between the belt S and the upper block 120.

Then, after the upper block 120 is moved down by the pressing mechanism 130 so that the upper block 120 and the belt S are brought into light contact with each other, the state is maintained for 30 seconds to stabilize the contact state. Thereafter, the upper block 120 is pressed toward the belt S using the pressing mechanism 130.

The pressurization to the belt S is performed such that a pressed region PR of the belt S pinched between the curved convex surface 112 and the curved concave surface 122 is pressed for 50 [ms] so that the pressing force is increased at a pressing speed of 4 [kPa/ms], and after the pressing force of 200 [kPa] is reached, the state in which the pressed region PR is constantly pressed by the pressing force of 200 [kPa] is maintained as illustrated in FIGS. 5 and 6. Thereafter, the pressurization to the belt S is released when 3 seconds elapse after the pressurization starts.

At this time, the position of the measurement region MR which is the portion corresponding to the hole section 113 of the lower block 110 in the first main surface Sa of the belt S is measured using the displacement gage 150 for 3 seconds from the pressurization start time until the pressurization is released. At this time, the portion including the measurement region MR of the belt S is deformed to swell out toward the inside of the hole section 113 when the portion of the belt S positioned around the corresponding portion is pinched and compressed by the lower block 110 and the upper block 120, and the position of the measurement region MR is displaced with the deformation.

At the time of measurement of the base line and at the time of measurement of the position of the measurement region MR, an output of the displacement gage 150 is acquired by a digital oscilloscope DL 1640 available from Yokogawa Electric Corporation. At this time, a sampling period is assumed to be 5 [ms].

Then, differences thereof are obtained on the basis of the measured position of the measurement region MR and the base line, and the displacement of the measurement region MR of the belt S is calculated as chronological data.

The placement position of the belt S with respect to the lower block 110 is changed so that the position of the measurement region MR is changed, and the measurement is performed on the belt S of the measurement target 10 times in total.

<Typical Displacement Pattern>

When various belts including the elastic layer are evaluated by applying the belt evaluation method using the displacement measuring device 100, the following two patterns can be typically confirmed as a pattern indicating a behavior of the displacement of the measurement region of the belt.

Figure 7:
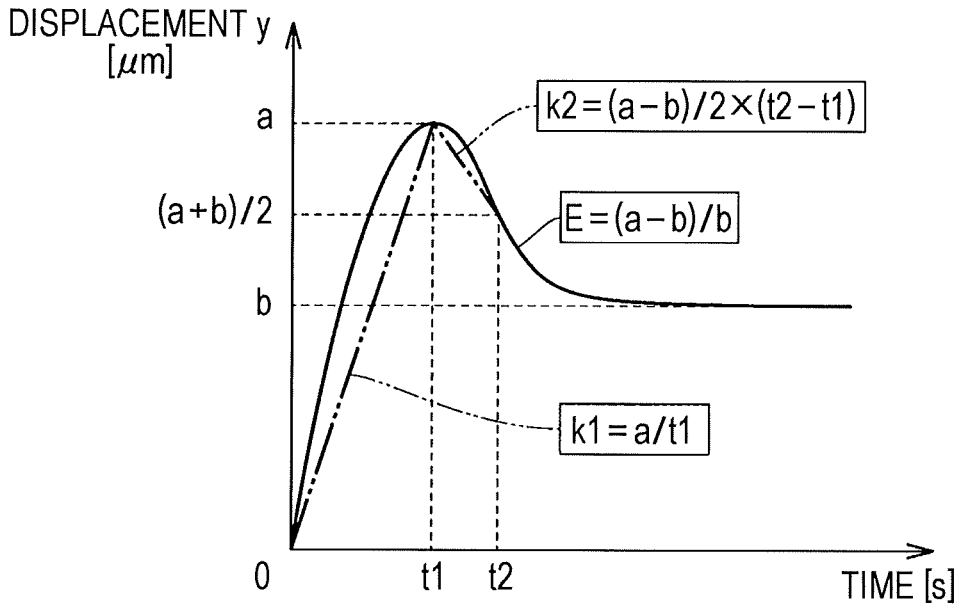
FIG. 7 is a graph illustrating a first pattern of behavior of displacement of a measurement region of a belt obtained when a belt is evaluated using the displacement measuring device illustrated in FIG. 3A.
Figure 8:
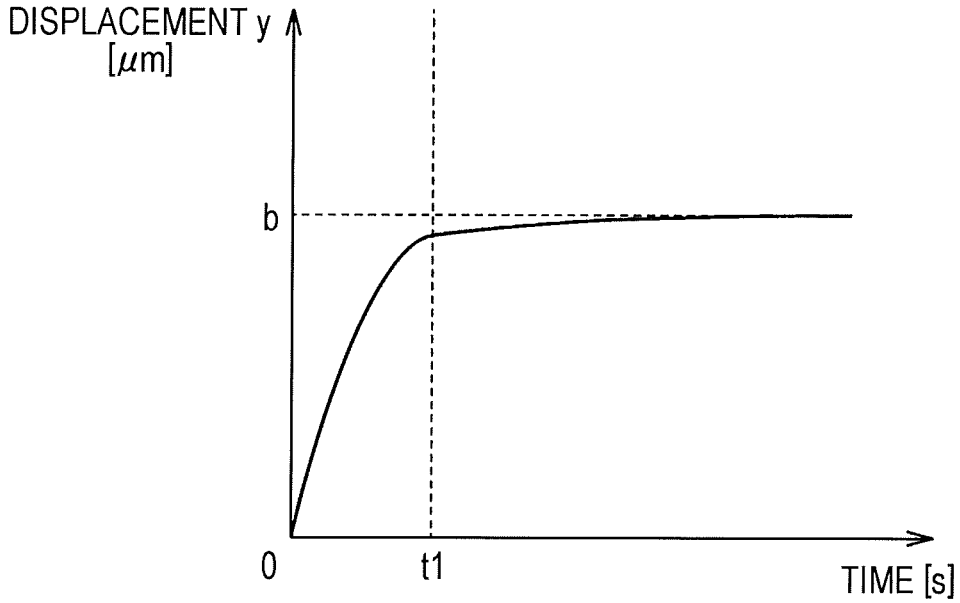
FIG. 8 is a graph illustrating a second pattern of behavior of displacement of a measurement region of a belt obtained when a belt is evaluated using the displacement measuring device illustrated in FIG. 3A.

FIGS. 7 and 8 are graphs illustrating a first pattern and a second pattern of the behavior of the displacement of the measurement region of the belt.

As illustrated in FIG. 7, the first pattern is a pattern in which after the pressurization starts, displacement y of the measurement region MR of the belt S increases with the increase in the pressing force of pressing the belt S, a local peak occurs in the displacement of the measurement region MR of the belt S around a point in time at which the pressing force of pressing the belt S reaches 200 [kPa] (that is, 50 [ms]), and then the displacement y of the measurement region MR of the belt S turns to decrease and gradually decreases with the passage of time and finally converges to predetermined displacement. In other words, the first pattern can be regarded as having an overshoot portion in the transition of the displacement of the measurement region MR of the belt S, and hereinafter, displacement in a situation in which the displacement y of the measurement region MR of the belt S increases in the first pattern is referred to as "primary displacement," and displacement in a situation in which the displacement y of the measurement region MR of the belt S decreases is referred to as "secondary displacement."

On the other hand, as illustrated in FIG. 8, the second pattern is a pattern in which after the pressurization starts, the displacement y of the measurement region MR of the belt S increases with the increase in the pressing force of pressing the belt S, no local peak occurs around a point in time at which the pressing force of pressing the belt S reaches 200 [kPa] (that is, 50 [ms]), and then the displacement y of the measurement region MR of the belt S gradually increases and converges to a predetermined displacement. In other words, the second pattern can be regarded as having no overshoot portion in the transition of the displacement of the measurement region MR of the belt S.

<Pattern of Displacement of Transfer Belt According to Present Embodiment>

The transfer belt 1 according to the present embodiment shows the first pattern (that is, the pattern having the overshoot portion) when the transfer belt 1 is evaluated by applying the belt evaluation method using the displacement measuring device 100 described above in detail.

This is based on a finding in which when the inventors of the present invention prepared a plurality of types of belts, that is, the belt showing the first pattern and the belt showing the second pattern, and formed an image on an embossed sheet using each belt as an intermediate transfer belt of an image forming device, the belt showing the first pattern is dramatically higher in the transfer property than the belt showing the second pattern. An experiment in which such a finding could been obtained (including an experiment of confirming a relation between each of an overshoot rate E, a primary displacement rate k1, and a secondary displacement rate k2 and ΔVadh and an experiment of confirming performance, which will be described later) will be described later in detail.

The reason why the high transfer property can be secured in the belt showing the first pattern will be described later in detail, but basically, it is because that even when the transfer belt is pressed from the back side (that is, the second main surface side), the surface (that is, the first main surface) greatly fluctuates. Therefore, in order to implement the transfer belt capable of securing the high transfer property for the recording medium having the concave-convex portions on the recording surface such as an embossed sheet, it is desirable to look at the overshoot portion.

Here, referring to FIG. 7, a maximum value of the displacement y which is the local peak of the displacement of the measurement region MR of the belt S is indicated by "a [μm]," and a convergence value which is the displacement y after the displacement of the measurement region MR of the belt S converges is indicated by "b [μm]." Further, a period of time from the pressurization start time to a point in time at which the maximum value a [μm] is observed is indicated by t1 [s], and a period of time from the pressurization start time to a point in time at which the displacement y of the measurement region MR of the belt S reaches (a+b)/2 again after the maximum value a [μm] is observed is indicated by "t2 [s]."

In addition, the overshoot rate E [−], the primary displacement rate k1 [μm/s], and the secondary displacement rate k2 [μm/s] are indicated by parameters indicating the behavior of the displacement of the measurement region MR of the belt S which is characteristic in the first pattern.

The overshoot rate E [−] is a parameter indicating a magnitude of overshoot and calculated by $E=(a-b)/b$.

The primary displacement rate k1 [μm/s] is a parameter indicating an increase rate of the primary displacement which is the displacement until the local peak is reached (that is, the displacement increase rate) and calculated by $k1=a/t1$.

The secondary displacement rate k2 [μm/s] is a parameter indicating a decrease rate of the secondary displacement which is the displacement after the local peak is reached (that is, the displacement decrease rate) and calculated by $k2=(a-b)/\{2\times(t2-t1)\}$.

The overshoot rate E [−], the primary displacement rate k1 [μm/s], and the secondary displacement rate k2 [μm/s] are parameters indicating degrees in which the surface (that is, the first main surface) fluctuates when the transfer belt is pressed from the back side (that is, the second main surface), and as the surface of the transfer belt fluctuates with a larger change, the parameters have larger values.

More specifically, when the overshoot rate E [−] has a relatively large value, the surface of the transfer belt is displaced more heavily. Further, when the primary displacement rate k1 [μm/s] has a relatively large value, the primary displacement of the transfer belt occurs at a higher speed. Further, when the secondary displacement rate k2 [μm/s] has a relatively large value, the secondary displacement of the transfer belt occurs at a higher speed.

Here, the transfer belt 1 according to the present embodiment satisfies at least one of the following first to third conditions. The first to third conditions are derived from a result of the experiment of confirming the relation between each of the overshoot rate E, the primary displacement rate k1, and the secondary displacement rate k2 and ΔVadh and a result of the experiment of confirming the performance which will be described later.

The first condition is a condition that the overshoot rate E [−] satisfies $0.2\leq E\leq 3$. When the transfer belt 1 that satisfies the first condition is employed, it is possible to implement the high transfer property even for the recording medium having the concave-convex portions on the surface, and it is possible to suppress the image grade from being deteriorated by the repetitive use.

When the overshoot rate E [−] is $E<0.2$, although the transfer belt is pressed from the back side, the surface does not fluctuate too much, and the sufficient effect is unable to be expected in terms of the transfer property. On the other hand, when the overshoot rate E [−] is $3<E$, the transfer belt is likely to crack or be abraded at an early stage due to the repetitive use, and the image grade is likely to deteriorate.

The second condition is a condition that the primary displacement rate k1 [μm/s] satisfies $60\leq k1\leq 320$. When the transfer belt 1 that satisfies the second condition is employed, it is possible to implement the high transfer property even for the recording medium having the concave-convex portions on the surface, and it is possible to suppress the image grade from being deteriorated by the repetitive use.

When the primary displacement rate k1 [μm/s] is $k1<60$, although the transfer belt is pressed from the back side, the surface does not fluctuate too much, and the sufficient effect is unable to be expected in terms of the transfer property. On the other hand, when the primary displacement rate k1 [μm/s] is $320<k1$, the transfer belt is likely to crack or be abraded at an early stage due to the repetitive use, and the image grade is likely to deteriorate.

The third condition is a condition that the secondary displacement rate k2 [μm/s] satisfies $6\leq k2\leq 30$. When the transfer belt 1 that satisfies the third condition is employed, it is possible to implement the high transfer property even for the recording medium having the concave-convex portions on the surface, and it is possible to suppress the image grade from being deteriorated by the repetitive use.

When the secondary displacement rate k2 [μm/s] is $k2<6$, although the transfer belt is pressed from the back side, the surface does not fluctuate too much, and the sufficient effect is unable to be expected in terms of the transfer property. On the other hand, when the secondary displacement rate k2 [μm/s] is $30<k2$, the transfer belt is likely to crack or be abraded at an early stage due to the repetitive use, and the image grade is likely to deteriorate.

Here, when the transfer belt 1 satisfies one of the first to third conditions, it is possible to secure the sufficiently high transfer property, but it is possible to secure a higher transfer property when the transfer belt 1 satisfies two of the first to third conditions, and it is possible to secure an extremely high transfer property when the transfer belt 1 satisfies all of the first to third conditions.

In addition, it is desirable that the convergence value b [μm] further satisfy a condition of $4 \leq b \leq 8$ as a fourth condition on the assumption that at least one condition among the first to third conditions is satisfied. When the transfer belt 1 that further satisfies the fourth condition is employed, the implementation of the high transfer property and the suppression of the deterioration in the image grade are further reliably performed.

The overshoot rate E [−], the primary displacement rate k1 [μm/s], and the secondary displacement rate k2 [μm/s] are obtained by calculating an average value of remaining four values after excluding three large values and three small values among values calculated from a total of 10 pieces of chronological data obtained by changing the position of the measurement region MR in the belt evaluation method using the displacement measuring device 100.

<Relation Between Displacement Pattern and Transfer Property>

Then, the reason why the high transfer property can be secured when image forming is performed on the embossed sheet by using the belt showing the first pattern as the intermediate transfer belt of the image forming device will be described in detail.

Figure 9A:
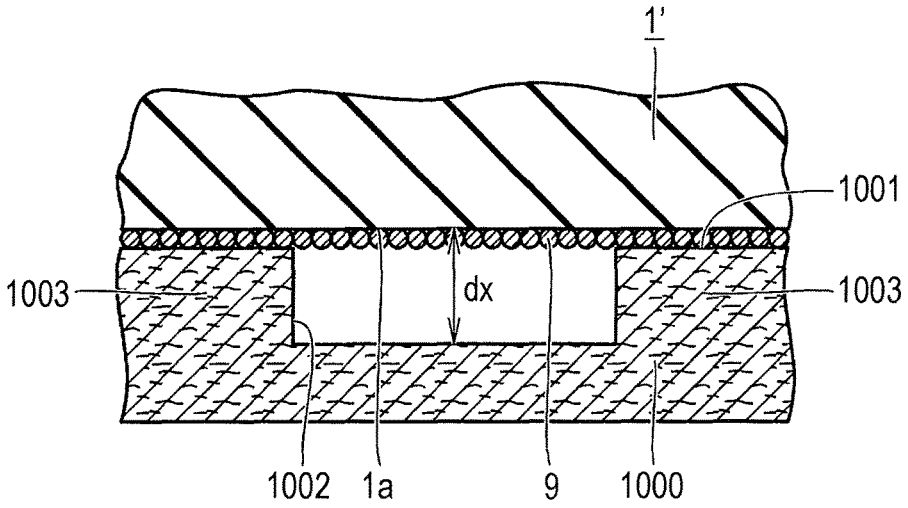
FIGS. 9A and 9B are a schematic view and a graph for describing a movement form of a toner from a transfer belt to an embossed sheet and a relation between an applied voltage and transfer efficiency when a transfer belt including only an elastic layer is used.
Figure 9B:
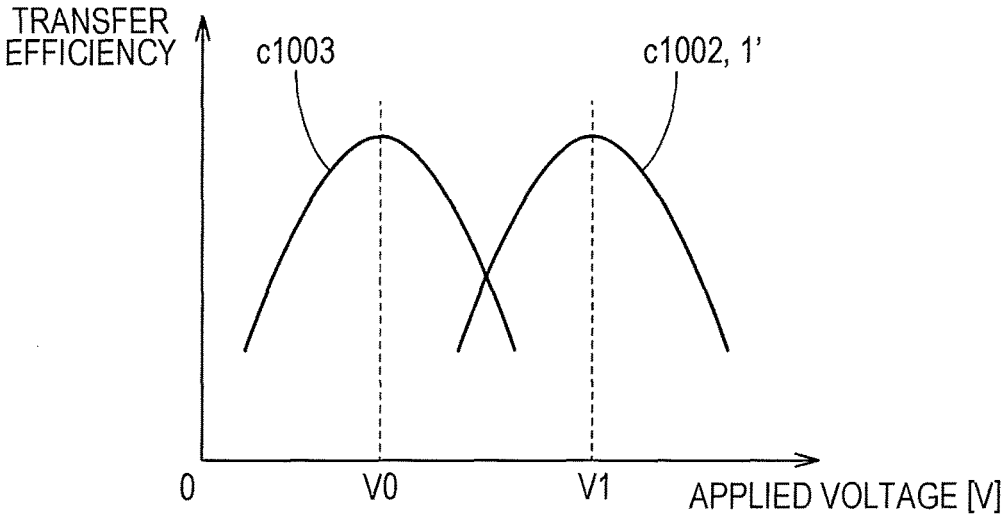

FIG. 9A is a schematic view illustrating a movement form of the toner from the transfer belt to the embossed sheet when a transfer belt including only an elastic layer is used, and FIG. 9B is a graph illustrating a relation between an applied voltage and the transfer efficiency in this case.

As illustrated in FIG. 9A, when the toner image is transferred onto an embossed sheet 1000 using a transfer belt 1' including only an anelastic layer, a recording surface 1001 of a portion of the embossed sheet 1000 in which a concave portion 1002 is not positioned (which is referred to as a convex portion 1003 for the sake of convenience) comes into contact with a toner 9 positioned on a first main surface 1*a* of the transfer belt 1'. On the other hand, the recording surface 1001 of a portion in which the concave portion 1002 of the embossed sheet 1000 is positioned does not come into contact with the toner 9 positioned on the first main surface 1*a* of the transfer belt 1'.

Therefore, in order to move the toner 9 to the bottom surface of the concave portion 1002 of the embossed sheet 1000, it is necessary to cause the toner 9 to fly from the transfer belt 1'. In order to cause the toner 9 to fly from the transfer belt 1', it is necessary for force which the toner 9 receives from the electric field to overcome adhesion force of the toner 9 to the transfer belt 1'. The adhesion force is a sum of non-electrostatic adhesion force (van der Waals force) and electrostatic adhesion force (electrostatic attraction caused by charges of the charged toner and the mirror image charges generated in the transfer belt).

Here, when a charge amount of the toner 9 is q, a potential difference between the embossed sheet 1000 and the transfer belt 1' is dV, and a distance between the embossed sheet 1000 and the transfer belt 1' is dx, force F which the toner 9 receives from the electric field is indicated by $F=q \times dV/dx$. As understood from the relation, since the force F is proportional to the potential difference dV between the embossed sheet 1000 and the transfer belt 1', as the distance dx increases, the applied voltage necessary for causing the toner 9 to fly increases.

Therefore, as illustrated in FIG. 9B, an applied voltage V1 at which the transfer efficiency is maximum in the concave portion 1002 is higher than an applied voltage V0 at which the transfer efficiency is maximum in the convex portion 1003. In FIG. 9B, a curve indicating a relation between the applied voltage and the transfer efficiency with respect to the convex portion 1003 is indicated by a reference numeral c1003, a curve indicating a relation between the applied voltage and the transfer efficiency with respect to the concave portion 1002 is indicated by a reference numeral c1002 (1').

Typically, in the image forming device, the applied voltage is set to about the applied voltage V0 at which the transfer efficiency is maximum in the convex portion 1003. Therefore, as the transfer efficiency in the concave portion 1002 at about the applied voltage V0 increases, an image density difference between the concave portion 1002 and the convex portion 1003 of the embossed sheet 1000 decreases, resulting in a high-quality image.

Figure 10A:
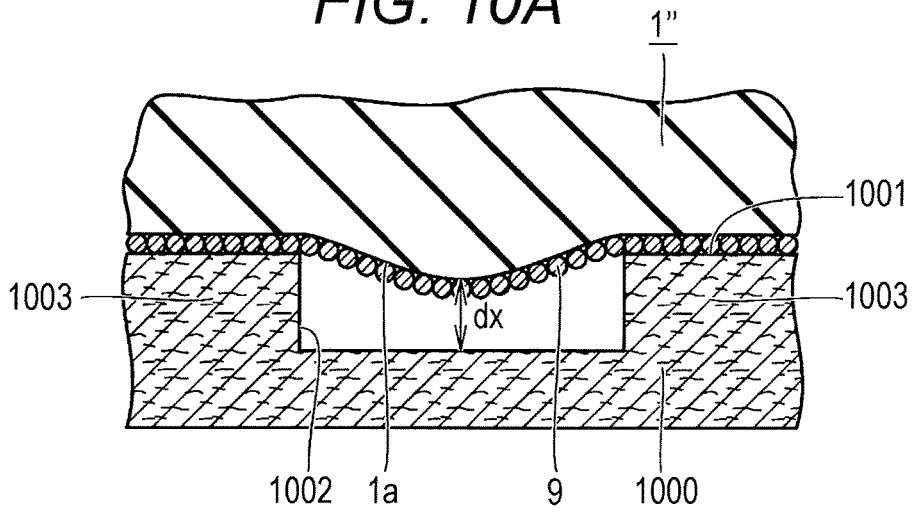
FIGS. 10A and 10B are a schematic view and a graph for describing a movement form of a toner from a transfer belt to an embossed sheet and a relation between an applied voltage and transfer efficiency when a transfer belt including an elastic layer is used.
Figure 10B:
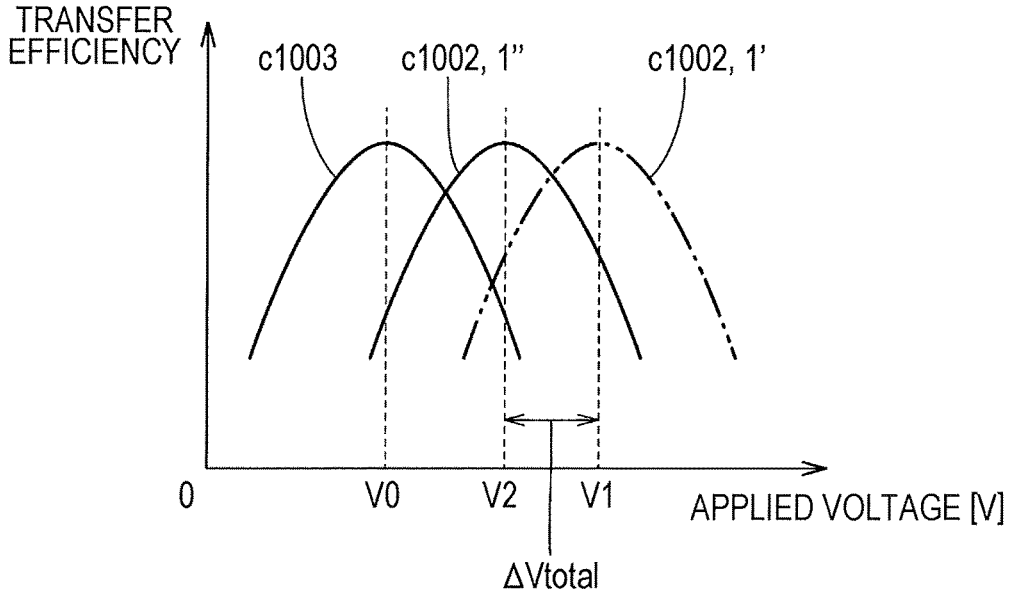

FIG. 10A is a schematic view illustrating a movement form the toner from the transfer belt to the embossed sheet when the transfer belt including the elastic layer is used, and FIG. 10B is a graph illustrating a relation between the applied voltage and the transfer efficiency in this case.

As illustrated in FIG. 10A, when a transfer belt 1" including an elastic layer is used, generally, the transfer belt 1" is deformed so that a part of the transfer belt 1" on the first main surface 1*a* side sinks to the concave portion 1002 of the embossed sheet 1000, and thus the distance dx between the bottom surface of the concave portion 1002 of the embossed sheet 1000 and the transfer belt 1" will be decreased. Therefore, an effect that the applied voltage at which the transfer efficiency is the maximum in the concave portion 1002 is reduced is obtained. This effect is a previously known effect and here referred to as a "follow-up deformation effect."

On the other hand, when the transfer belt 1" including the elastic layer shows the first pattern, the first main surface 1*a* largely fluctuates at the time of deformation of the transfer belt 1", and when the first main surface 1*a* is deformed to be expanded and contracted, a position relation between the transfer belt 1" and the toner 9 attached thereto (that is, the distance between the toner 9 and the first main surface 1*a*, its contact area, or the like) changes, and the adhesion force of the toner 9 to the transfer belt 1" is decreased. Therefore, an effect that the applied voltage at which the transfer efficiency is maximum in the concave portion 1002 is further reduced is obtained. This effect is not a previously known effect, it is an effect which is currently found by the inventors of the present invention and here referred to as an "adhesion force reduction effect."

Accordingly, as illustrated in FIG. 10B, an applied voltage V2 at which the transfer efficiency is maximum in the concave portion 1002 is smaller than the applied voltage V1 at which the transfer efficiency in the concave portion 1002 is maximum when the transfer belt 1' including only the elastic layer is used. In FIG. 10B, a curve illustrating a relation between the applied voltage and the transfer efficiency with respect to the concave portion 1002 is indicated by a reference numeral c1002 (1").

Therefore, compared to when the transfer belt 1' including only the elastic layer is used, the transfer efficiency in the concave portion 1002 at about the applied voltage V0 is higher, the image density difference between the concave portion 1002 and the convex portion 1003 of the embossed sheet 1000 is smaller, and thus a higher quality image can be obtained. This point will be described in further detail below.

Figure 11:
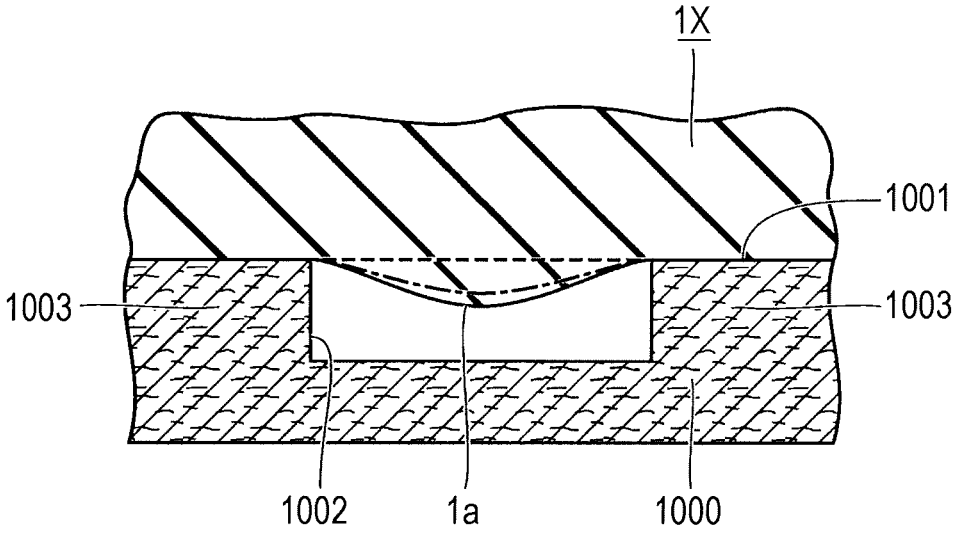
FIG. 11 is a schematic view for describing behavior with respect to a concave portion of an embossed sheet when a belt showing a second pattern illustrated in FIG. 8 is used as a transfer belt.
Figure 12:
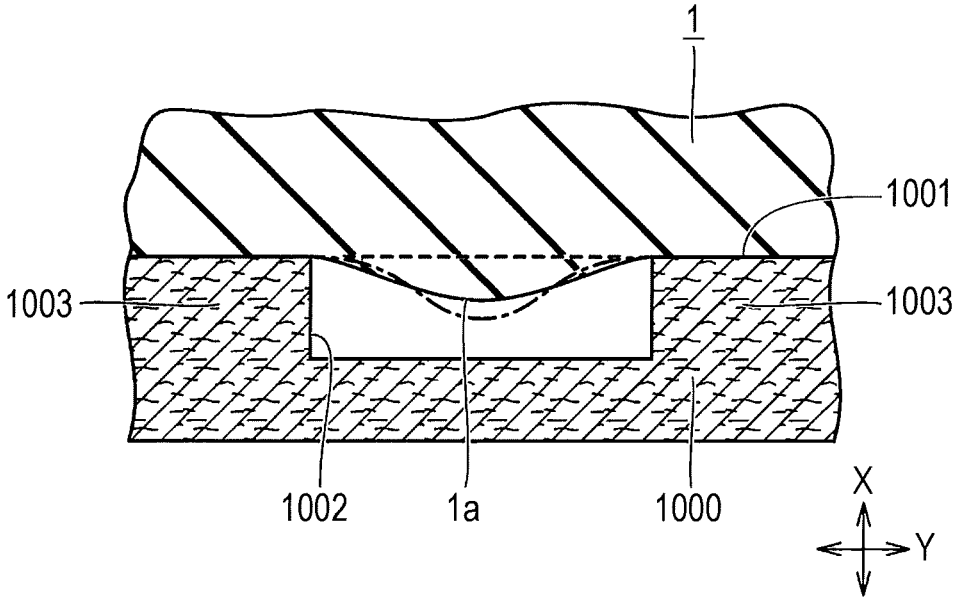
FIG. 12 is a schematic view for describing behavior with respect to a concave portion of an embossed sheet when a belt showing a first pattern illustrated in FIG. 7 is used as a transfer belt.

FIG. 11 is a schematic view for describing a behavior with respect to the concave portion of the embossed sheet when the belt showing the second pattern illustrated in FIG. 8 is used as the transfer belt, and FIG. 12 is a schematic view for describing a behavior with respect to the concave portion of the embossed sheet when the belt showing the first pattern illustrated in FIG. 7 is used as the transfer belt. In FIGS. 11 and 12, the toner is not illustrated in order to help with understanding.

As described above, when the transfer belt passes through the nip section of the secondary transfer section, the transfer belt is pinched by the secondary transfer roller and pressed. At that time, pressure which is received by one point on the transfer belt in the nip section temporally changes such that the pressure abruptly increases in an entrance side portion of the nip section, the pressure does not change relatively in a subsequent portion, and the pressure abruptly decreases in an exit side portion of the nip section.

FIG. 11 illustrates a behavior of the first main surface 1*a* of the transfer belt 1X with respect to the concave portion 1002 of the embossed sheet 1000 when the belt showing the second pattern illustrated in FIG. 8 is used as a transfer belt 1X. Here, in FIG. 11, a position of the first main surface 1*a* in a state in which the displacement does not occur is indicated by a broken line, a position of the first main surface 1*a* at a point in time at which the transfer belt 1X enters a portion in which the pressure does not change relatively after undergoing the abrupt increase in the pressure is indicated by an alternate long and short dash line, and then a position of the first main surface 1*a* at a point in time at which the transfer belt 1X exits in the portion in which the pressure does not change relatively and undergoes an abrupt decrease in the pressure is indicated by a solid line.

In this case, the transfer belt 1X is deformed so that the first main surface 1*a* of the portion facing the concave portion 1002 of the embossed sheet 1000 sinks, and the distance between the bottom surface of the concave portion 1002 of the embossed sheet 1000 and the transfer belt 1X is decreased accordingly. Accordingly, the follow-up deformation effect described above is obtained.

However, in this case, the displacement of the first main surface 1*a* of the portion facing the concave portion 1002 is based on simple deformation in which the first main surface 1*a* moves toward the bottom surface of the concave portion 1002. Therefore, the first main surface 1*a* does not greatly fluctuate, and slight expansion/contraction deformation merely occurs in the first main surface 1*a*.

Therefore, the position relation between the first main surface 1*a* and the toner adhered thereto does not change greatly, and the adhesion force of the toner to the transfer belt 1X is not greatly reduced. For this reason, the adhesion force reduction effect is hardly obtained.

On the other hand, FIG. 12 illustrates a behavior of the first main surface 1*a* of the transfer belt 1 with respect to the concave portion 1002 of the embossed sheet 1000 when the belt showing the first pattern illustrated in FIG. 7 is used as the transfer belt 1. Here, in FIG. 12, a position of the first main surface 1*a* in a state in which the displacement does not occur is indicated by a broken line, a position of the first main surface 1*a* at a point in time at which the transfer belt 1 enters a portion in which the pressure does not change relatively after undergoing the abrupt increase in the pressure is indicated by an alternate long and short dash line, and then a position of the first main surface 1*a* at a point in time at which the transfer belt 1 exits in the portion in which the pressure does not change relatively and undergoes an abrupt decrease in the pressure is indicated by a solid line.

In this case, the transfer belt 1 is deformed so that the first main surface 1*a* of the portion facing the concave portion 1002 of the embossed sheet 1000 sinks, and the distance between the bottom surface of the concave portion 1002 of the embossed sheet 1000 and the transfer belt 1 is decreased accordingly. Accordingly, the follow-up deformation effect described above is obtained.

Furthermore, in this case, distortion of the elastic layer included in the transfer belt 1 concentrates on the center of the first main surface 1*a* of the portion facing the concave portion 1002, and thus the primary displacement occurs so that the displacement of the first main surface 1*a* becomes the maximum in the portion, and then the secondary displacement which is return displacement occurs so that it gets away from the bottom surface of the concave portion 1002.

At that time, the deformation occurs in in the first main surface 1*a* of the portion facing the concave portion 1002 in not only a normal direction of the first main surface 1*a* (an X direction in FIG. 12) in a state before the deformation of the transfer belt 1 but also a direction perpendicular to the normal direction (a Y direction in FIG. 12), the deformations overlap, and thus complicated deformation occurs in the first main surface 1*a* at a high speed.

As a result, the position relation between the first main surface 1*a* and the toner adhered thereto largely changes, and the adhesion force of the toner to the transfer belt 1 is significantly reduced. Therefore, in addition to the follow-up deformation effect, the adhesion force reduction effect can be obtained, and the high transfer property can be implemented even for an embossed sheet having a deeper concave portion or the like.

As described above, the adhesion force reduction effect is an effect which is particularly remarkably obtained in the transfer belt showing the first pattern, and the degree of the obtained effect is largely related to the overshoot portion in the first pattern. In other words, when the primary displacement rate k1 [μm/s] is sufficiently large, the first main surface 1*a* of the transfer belt 1 undergoes the primary displacement at a high speed at the initial stage at which the transfer belt 1 passes through the nip section, and the high adhesion force reduction effect is obtained. Further, when the overshoot rate E [−] is sufficiently large, fast and complicated deformation occurs in the first main surface 1*a* of the transfer belt 1 at the intermediate stage at which the transfer belt 1 passes through the nip section, and the high adhesion force reduction effect is obtained. In addition, when the secondary displacement rate k2 [μm/s] is sufficiently large, the first main surface 1*a* of the transfer belt 1 undergoes the secondary displacement at a high speed at the final stage at which the transfer belt 1 passes through the nip section, and the high adhesion force reduction effect is obtained.

Here, referring to FIG. 10B, if a difference between the applied voltage V1 and the applied voltage V2 is ΔVtotal, a reduction width of the applied voltage at which the transfer efficiency is maximum in the concave portion 1002 by the follow-up deformation effect is ΔVgap, and a reduction width of the applied voltage at which the transfer efficiency is maximum in the concave portion 1002 by the adhesion force reduction effect is ΔVadh, a relation of ΔVtotal=ΔVgap+ΔVadh is held.

Since ΔVtotal is indicated by V1−V2 as described above, ΔVadh is indicated by V1−V2−ΔVgap. Each of V1 and V2 has a value unique to each transfer belt, but it is possible to derive the values through an experiment, and ΔVgap can be experimentally derived from the displacement y of the measurement region MR of the belt S measured in the belt evaluation method using the displacement measuring device 100. Therefore, ΔVadh can be calculated from the values through a calculation.

<Experiment of Confirming Relation Between Each of Overshoot Rate E, Primary Displacement Rate k1, and Secondary Displacement Rate k2 and ΔVadh>

The inventors of the present invention prepared various types and various amounts of resin, additives, crosslinking agents, and the like contained in the elastic layer, fabricated a plurality of belts including the elastic layers having different compositions, conducted an evaluation on the basis of the belt evaluation method using the displacement measuring device 100, and obtained the overshoot rate E, the primary displacement rate k1, and the secondary displacement rate k2 of the respective belts.

A plurality of belts that differ in the overshoot rate E, the primary displacement rate k1, and the secondary displacement rate k2 were selected from among the belts, the transfer efficiency for the concave portion of the embossed sheet was experimentally measured using a plurality of selected belts, and a value of V2 of each belt was obtained. Here, the V2 was measured using the displacement measuring device 100 illustrated in FIG. 3A such that the belt of the measurement target and the embossed sheet were arranged to be interposed between the lower block 110 and the upper block 120, a voltage was applied to the lower block 110 and the upper block 120 so that a potential difference occurs between the lower block 110 and the upper block 120, and a voltage at which the transfer efficiency is highest was obtained as V2 while variously changing the applied voltage.

The value of V1 was obtained by performing similar measurement using the anelastic belt, and ΔVgap was calculated through a calculation from the displacement of the measurement region MR of each belt measured in the belt evaluation method using the displacement measuring device 100.

Figure 13:
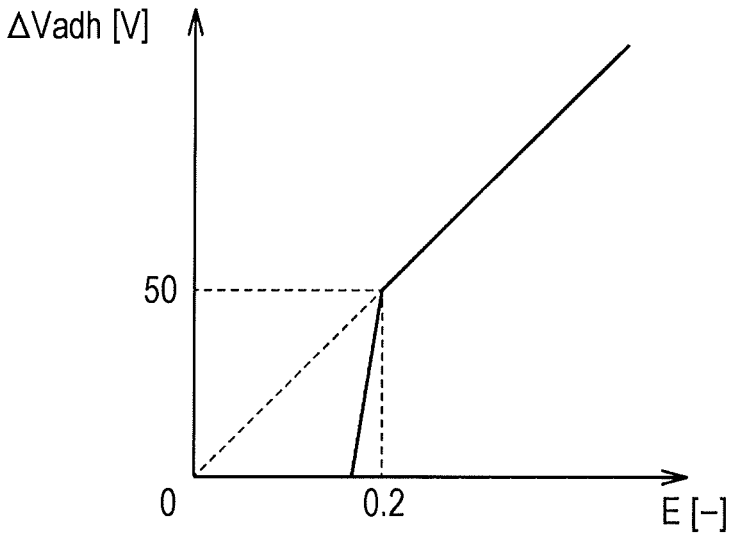
FIG. 13 is a graph illustrating a relation between an overshoot rate E and $\Delta Vadh$.
Figure 14:
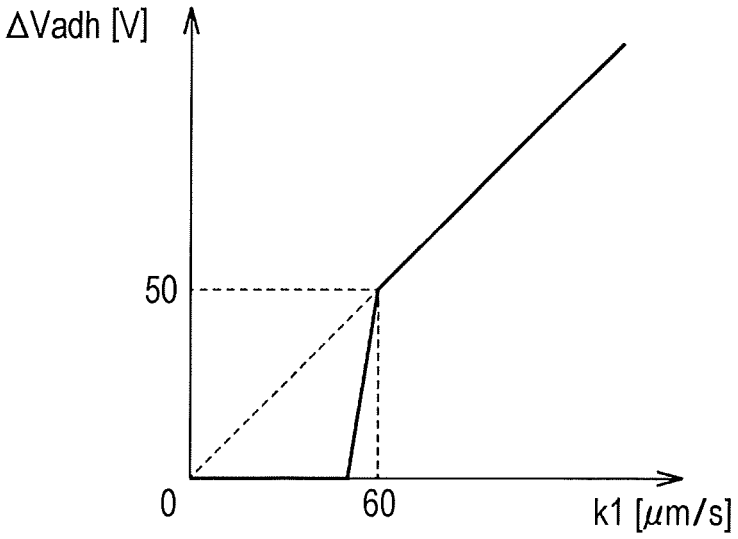
FIG. 14 is a graph illustrating a relation between a primary displacement rate k1 and $\Delta Vadh$.
Figure 15:
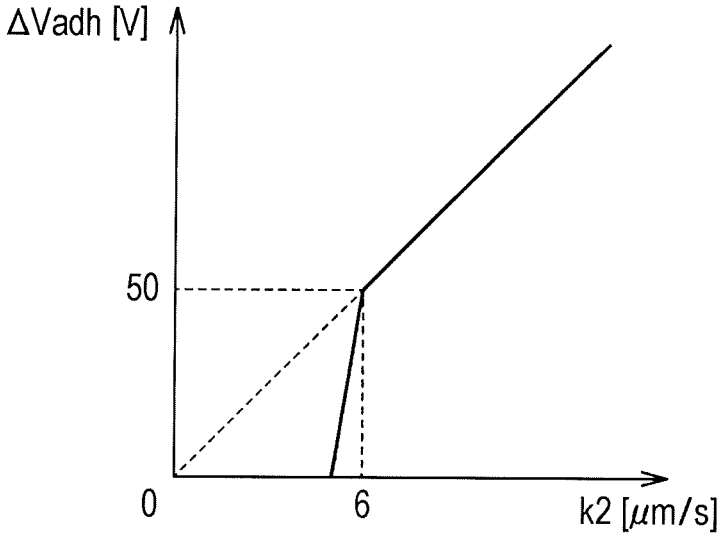
FIG. 15 is a graph illustrating a relation between a secondary displacement rate k2 and $\Delta Vadh$.

The relation between each of the overshoot rate E, the primary displacement rate k1, and the secondary displacement rate k2 and ΔVadh was organized on the basis of data of each belt. FIG. 13 is a graph illustrating a relation between the overshoot rate E and ΔVadh. FIG. 14 is a graph illustrating a relation between the primary displacement rate k1 and ΔVadh, and FIG. 15 is a graph illustrating a relation between the secondary displacement rate k2 and ΔVadh. In the belt showing the second pattern, since the displacement y has no local peak, the displacement y is decided to be the maximum value a at 50 [ms].

As can be understood from FIG. 13, it was confirmed that in the relation between overshoot rate E and ΔVadh, in the range of $0 \leq E \leq 0.2$, ΔVadh is less than 50 [V], and little adhesion force reduction effect is obtained. On the other hand, it was confirmed that in the range of $0.2 \leq E$, as the value of the overshoot rate E increases, ΔVadh tends to increase and exceed 50 [V], and the high adhesion force reduction effect is obtained.

As can be understood from FIG. 14, it was confirmed that in the relation between the primary displacement rate k1 and ΔVadh, in the range of $0 \leq k1 < 60$, ΔVadh is less than 50 [V], and little adhesion force reduction effect is obtained. On the other hand, it was confirmed that in the range of $60 \leq k1$, as the value of the primary displacement rate k1 increases, ΔVadh tends to increase and exceed 50 [V], and the high adhesion force reduction effect is obtained.

As can be understood from FIG. 15, it was confirmed that in the relation between the secondary displacement rate k2 and ΔVadh, in the range of $0 \leq k2 < 6$, ΔVadh is less than 50 [V], and little adhesion force reduction effect is obtained. On the other hand, it was confirmed that in the range of $6 \leq k2$, as the value of the secondary displacement rate k2 increases, ΔVadh tends to increase and exceed 50 [V], and the high adhesion force reduction effect is obtained.

The above result is the basis for deciding lower limit values of the overshoot rate E, the primary displacement rate k1, and the secondary displacement rate k2 in the first to third conditions, and indicates that when a condition of a lower limit value side of any one of the first to third conditions is satisfied, the satisfactory adhesion force reduction effect is obtained in addition to the follow-up deformation effect.

<Experiments of Confirming Performance>

The inventors of the present invention conducted an experiment of preparing various types and various amounts of resin, additives, crosslinking agents, and the like contained in the elastic layer, fabricating a plurality of belts including the elastic layers having different compositions, conducting an evaluation on the basis of the belt evaluation method using the displacement measuring device 100, obtaining the overshoot rate E, the primary displacement rate k1, and the secondary displacement rate k2 of the respective belts, and confirming performance of each belt under a predetermined condition.

In the experiment of confirming the performance, an image forming device (a digital multifunction printer: bizhub PRESS C6000) available from Konica Minolta was used, and the intermediate transfer belt installed in the image forming device was replaced with various kinds of belts described above, and the diameter or secondary transfer pressure of the secondary transfer roller was changed or adjusted as necessary.

In the experiment of confirming the performance, in Experimental Examples 1 to 18 that differ in at least one of a belt type and an image forming condition, whether the transfer property to the concave portion of the embossed sheet is good or bad, the presence or absence of the occurrence of an image noise after 10,000 sheets are printed, whether transfer uniformity in the axial direction of the secondary transfer roller is good or bad, and the presence or absence of dropout were confirmed. The dropout is a phenomenon in which a transfer failure occurs in a central portion of a fine line, a halftone dot, or the like when an image such as a fine line or a halftone dot is formed.

FIG. 16 is a table illustrating image forming conditions and image forming results of an experiment of confirming the performance. As illustrated in FIG. 16, a total of 10 types of transfer belts A to I and X which differ in a composition of the elastic layer were prepared as a belt type, the transfer pressure was set to a total of five steps between 70 [kPa] and 500 [kPa], and the diameter of the secondary transfer roller was set to a total of 5 steps between 16 [mm] and 70 [mm].

Here, all of the belt types A to I were fabricated by the inventors of the present invention, a material of the base layer is polyimide, and a material of the elastic layer is nitrile rubber. On the other hand, the belt type X is an intermediate transfer belt that was not fabricated by the inventors of the present invention and used in commercially available image forming devices, a material of the base layer is polyimide, and a material of the elastic layer is chloroprene rubber.

Before the experiment of confirming the performance, image forming was preliminarily performed, and as a result, it was confirmed that, when the hardness of the surface of the secondary transfer roller is higher than the hardness of the surface of the opposite roller, the transfer property to the concave portion of the embossed sheet is more excellent than when the hardness of the surface of the secondary transfer roller is lower than the hardness of the surface of the opposite roller or the hardness of the surface of the secondary transfer roller is equal to the hardness of the surface of the opposite roller.

This is because, as illustrated in FIG. 2, when the hardness of the surface of the secondary transfer roller 6 is higher than the hardness of the surface of the opposite roller 7, the concave line-like curved surface is formed on the first main surface 1*a* of the transfer belt 1, and since the surface portion of the concave line-like curved surface is a portion to be compressed, large deformation is likely to occur, and an action of promoting the deformation of the first main surface 1*a* is easily performed accordingly.

(Whether Transfer Property is Good or Bad)

In order to confirm whether the transfer property is good or bad, an embossed sheet made by Special Tokai Paper Co., Ltd., a trade name LESAC 66 (LESAC is a registered trademark), was used. A basis weight of the embossed sheet is 302 [g/m$^2$]. An image to be formed was a solid image. At the time of determination, reflected density of a sharp concave portion having a large depth and reflected density of a convex portion were measured using a microdensitometer, and a density differences was calculated. "Good" was determined when the density difference is less than 0.25, "acceptable" was determined when the density difference is 0.25 or more and less than 0.40, and "bad" was determined when the density difference is 0.40 or more.

(Presence or Absence of Occurrence of Image Noise)

The presence or absence of the occurrence of an image noise was confirmed by printing a solid image through the same apparatus after printing 10,000 sheets and observing an image quality of the solid image. Neither crack nor abrasion was observed in the transfer belt after printing 10,000 sheets. At the time of determination, "good" was determined when the transfer belt is neither cracked nor abraded, and an image has no noise, "acceptable" was determined when the transfer belt is cracked or abraded, but an image has no noise, and "bad" was determined when the transfer belt is cracked or abraded, and an image has a noise.

(Whether Transfer Uniformity in Axial Direction is Good or Bad)

A coated sheet was used to confirm the transfer uniformity of the secondary transfer roller in the axial direction. A basis weight of the coated sheet is 151 [g/m$^2$]. An image to be formed was a solid image. At the time of determination, reflection density was measured at 20 random positions in a longitudinal direction of the coated sheet using a microdensitometer, and a density difference between a maximum value and a minimum value of the measured reflected density was calculated. "Good" was determined when the density difference is less than 0.10, "acceptable" was determined when the density difference is 0.10 or more and less than 0.20, and "bad" was determined when the density difference is 0.20 or more.

(Presence/Absence of Dropout)

A coated sheet was used to confirm the presence or absence of dropout. A basis weight of the coated sheet is 151 [g/m$^2$]. An image to be formed was five fine lines with a length of 60 mm and a width of 3 dots, and the presence or absence of turbulence of an image was confirmed by observing them through a magnifying glass. At the time of determination, "good" was determined when there is no turbulence in the fine lines, "acceptable" was determined when there is a slight turbulence in the fine lines, and "bad" was determined when there is an unacceptable turbulence in the fine lines.

(Comprehensive Evaluation)

In a comprehensive evaluation, "bad" was evaluated when "bad" is included in all of whether the transfer property is good or bad, the presence/absence of the occurrence of an image noise, whether the transfer uniformity in the axial direction is good or bad, and the presence or absence of dropout, "good" or "acceptable" was evaluated when "bad" is not included but "acceptable" is included in all of them, and "excellent" was evaluated when "good" is included in all of them. The difference between "good" and "acceptable" in the comprehensive evaluation is that "good" is evaluated when "good" is included in whether the transfer property is good or bad and the presence or absence of the occurrence of the image noise, and "acceptable" is evaluated when "acceptable" is included in at least one of them.

(Experiment Results)

As can be understood from FIG. 16, in Experimental Examples 1 to 13, 16, and 17 in which the overshoot rate E [−] satisfies $0.2 \leq E \leq 3$ (that is, satisfies the first condition), the adhesion force reduction effect was sufficiently implemented, a satisfactory transfer property was obtained even in the concave portion of the embossed sheet, and satisfactory results were obtained in terms of the image grade and durability. On the other hand, in Experimental Examples 14 and 18 in which the overshoot rate E [−] is $E<0.2$, the adhesion force reduction effect was not sufficiently implemented, and the satisfactory transfer property was not obtained in the concave portion of the embossed sheet. In the case of Experimental Example 15 in which the overshoot rate E [−] is $3<E$, the image noise occurred by the repetitive use, and there was a problem in terms of the image grade and durability.

The above result is the basis for deciding the upper limit value and the lower limit value of the overshoot rate E under the first condition, and when the transfer belt satisfying the first condition is employed, it is possible to implement the high transfer property even for the recording medium having the concave-convex portions on the surface, and it is possible to suppress the image grade from being deteriorated by the repetitive use.

As can be understood from FIG. 16, in Experimental Examples 1 to 13, 16, and 17 in which the primary displacement rate k1 [μm/s] satisfies $60 \leq k1 \leq 320$ (that is, satisfies the second condition), the adhesion force reduction effect was sufficiently implemented, a satisfactory transfer property was obtained even in the concave portion of the embossed sheet, and a satisfactory result was obtained in terms of the image grade and durability. On the other hand, in the case of Experimental Examples 14 and 18 in which the primary displacement rate k1 [μm/s] is $k1<60$, the adhesion force reduction effect was not sufficiently implemented, and the satisfactory transfer property was not obtained in the concave portion of the embossed sheet. Further, in Experimental Example 15 in which the primary displacement rate k1 [μm/s] is $320<k1$, the image noise occurred by the repetitive use, and there was a problem in terms of the image grade and durability.

The above result is the basis for deciding the upper limit value and the lower limit value of the primary displacement rate k1 under the second condition, and when the transfer belt satisfying the second condition is employed, it is possible to implement the high transfer property even for the recording medium having the concave-convex portions on the surface, and it is possible to suppress the image grade from being deteriorated by the repetitive use.

Further, as can be understood from FIG. 16, in Experimental Examples 1 to 13, 16, and 17 in which the secondary displacement rate k2 [μm/s] satisfies 6≤k2≤30 (that is, satisfies the third condition), the adhesion force reduction effect was sufficiently implemented, a satisfactory transfer property was obtained even in the concave portion of the embossed sheet, and a satisfactory result was obtained in terms of the image grade and durability. On the other hand, in the case of Experimental Examples 14 and 18 in which the secondary displacement rate k2 [μm/s] is k2<6, the adhesion force reduction effect was not sufficiently implemented, and the satisfactory transfer property was not obtained in the concave portion of the embossed sheet. Further, in Experimental Example 15 in which the secondary displacement rate k2 [μm/s] is 30<k2, the image noise occurred by the repetitive use, and there was a problem in terms of the image grade and durability.

The above result is the basis for deciding the upper limit value and the lower limit value of the secondary displacement rate k2 under the third condition, and when the transfer belt satisfying the third condition is employed, it is possible to implement the high transfer property even for the recording medium having the concave-convex portions on the surface, and it is possible to suppress the image grade from being deteriorated by the repetitive use.

Further, as can be understood from FIG. 16, in Experimental Examples 1 to 13 in which the convergence value b [μm] further satisfies 4≤b≤8 (that is, satisfies the fourth condition) under the assumption that any one of the first to third condition is set, the adhesion force reduction effect was sufficiently implemented, an extremely satisfactory transfer property was obtained even in the concave portion of the embossed sheet, and an extremely satisfactory result was obtained in terms of the image grade and durability.

Further, as can be understood from FIG. 16, in Experimental Examples 1 to 11, 16, and 17 in which the diameter of the secondary transfer roller is 20 [mm] or more and 60 [mm] or less under the assumption that any one of the first to third conditions is set, a satisfactory transfer property was obtained even in the concave portion of the embossed sheet, abrasion resistance was satisfactory, the density difference in the axial direction and the dropout were also at acceptable levels. On the other hand, in Experimental Example 12 in which the diameter of the secondary transfer roller is less than 20 [mm], there was some density difference in the axial direction due to bending of the secondary transfer roller. In Experimental Example 13 in which the diameter of the secondary transfer roller exceeds 60 [mm], the dropout occurred, and fine line reproducibility slightly deteriorated.

Therefore, when the diameter of the secondary transfer roller is set to 20 [mm] or more and 60 [mm] or less under the assumption that any one of the first to third conditions is set, it is possible to form a high grade image.

Further, as can be understood from FIG. 16, in Experimental Examples 1 to 9, 12, 13, 16, and 17 in which the maximum pressure in the nip section of the secondary transfer section is 100 [kPa] or more and 400 [kPa] or less under the assumption that anyone of the first to third conditions is set, a satisfactory transfer property was obtained even in the concave portion of the embossed sheet, the abrasion resistance was also satisfactory, the density difference in the axial direction and the dropout were also at the acceptable levels. On the other hand, in the case of Experimental Example 10 in which the maximum pressure in the nip section of the secondary transfer section is less than 100 [kPa], the transfer pressure was unstable, and a slight density difference occurred in the axial direction. Further, in Experimental Example 11 in which the maximum pressure in the nip section of the secondary transfer section exceeds 400 [kPa], the dropout occurred since the transfer pressure was too high, and the fine line reproducibility slightly deteriorated.

Therefore, when the maximum pressure in the nip section of the secondary transfer section is set to 100 [kPa] or more and 400 [kPa] or less on the assumption that any one of the first to third conditions is set, it is possible to form a high grade image.

<Additional Experiment>

The inventors of the present invention conducted an additional experiment to be described below and confirmed that an effect that separability of the recording medium from the transfer belt after the transfer and an effect that cleaning property for the transfer belt are obtained as secondary effects according to the present invention.

In carrying out the additional experiment, the inventors of the present invention prepared various types and various amounts of resin, additives, crosslinking agents, and the like contained in the elastic layer, fabricated a plurality of belts including the elastic layers having different compositions, conducted an evaluation on the basis of the belt evaluation method using the displacement measuring device 100, obtained the secondary displacement rate k2 of each belt, and selected a plurality of belts that differ in the secondary displacement rate k2.

In the additional experiment, similarly to the case of confirming the performance, the image forming device (digital multifunction peripheral: bizhub PRESS C 6000) available from Konica Minolta was used, the intermediate transfer belt installed in the image forming device was sequentially replaced with a plurality of belts described above, and the separability and the cleaning property of the recording medium were confirmed.

FIG. 17 is a table illustrating image forming conditions and image forming results of the additional experiment. As illustrated in FIG. 17, a total of five types of transfer belts J to N which differ in the composition of the elastic layer were prepared as the belt type, the transfer pressure was all set to 200 [kPa], and the secondary transfer roller was all set to 40 [mm].

Here, all of the belt types J to N were fabricated by the inventors of the present invention, a material of the base layer is polyimide, and a material of the elastic layer is nitrile rubber.

(Whether Separability of Recording Medium is Good or Bad)

In order to confirm whether the separability of the recording medium is good or bad, plain sheet made by Konica Minolta, a trade name J paper, was used. A basis weight of the plain sheet is 64 [g/m$^2$]. An image to be formed was an image with different densities, and 1,000 sheets were printed. Determination is performed on the basis of the number of paper jams caused by poor separation of the plain sheet in the secondary transfer section during that period, and "good" was determined when no paper jam occurred, "acceptable" was determined when one to three paper jams occurred, and "bad" was determined when four or more paper jams occurred.

(Whether Cleaning Property is Good or Bad)

In order to confirm whether the cleaning property is good or bad, an embossed sheet made by Special Tokai Paper Co., Ltd., a trade name LESAC 66 (LESAC is a registered trademark), was used. A basis weight of the embossed sheet is 302 [g/m$^2$]. At the time of determination, it was observed whether or not a formed image has an image noise caused by unwiping of a cleaning blade of a cleaning section. "Good" was determined when this type of image noise is not present, "acceptable" was determined when this type of image noise is present at an acceptable level, and "bad" was determined when this type of image noise is present at an unacceptable level.

(Experiment Results)

As is apparent from the experiment results of Experimental Examples 19 to 23 illustrated in FIG. 17, when the transfer belt having the large secondary displacement rate k2 [μm/s] is used, the separability of the recording medium was satisfactory. In the transfer of the toner image onto a non-embossed sheet, since a step difference of the concave-convex portion is small, the surface of the transfer belt is deformed to completely follow the concave-convex portion of the recording medium, the contact area between the surface of the transfer belt and the surface of the recording medium is large, and the separability is likely to deteriorate accordingly. However, when the transfer belt with the large secondary displacement rate k2 [μm/s] is used, even though the surface of the transfer belt is deformed to completely follow the concave-convex portion of the recording medium in the center portion of the nip section in which the transfer pressure is maximized, since the exit portion of the nip section has been already recovered from the deformation, the contact area between the surface of the transfer belt and the surface of the recording medium is small, and thus the recording medium is easily separated from the transfer belt. On the other hand, when the transfer belt with the small secondary displacement rate k2 [μm/s] is used, since the deformation is not eliminated near the exit portion of the nip section after the surface of the transfer belt is deformed to completely follow the concave-convex portion of the recording medium in the center portion of the nip section, the contact area between the surface of the transfer belt and the surface of the recording medium is large, and the recording medium is difficult separate from the transfer belt.

Further, as is apparent from the experiment results of Experimental Examples 19 to 23 illustrated in FIG. 17, when the transfer belt having the small secondary displacement rate k2 [μm/s] is used, the cleaning property deteriorates. This is because the deformation of the surface of the transfer belt is not eliminated although the transfer belt reaches the cleaning section after the transfer belt is deformed to follow the step difference of the concave-convex sheet in the secondary transfer section, the surface of the transfer belt has the concave-convex portion, and thus a part of the residual toner slips through the cleaning belt, resulting in poor cleaning. On the other hand, when the transfer belt having the large secondary displacement rate k2 [μm/s] is used, when the transfer belt reaches the cleaning section after the transfer belt is deformed to follow the step difference of the concave-convex sheet in the secondary transfer section, the surface of the transfer belt has already recovered from the deformation, and thus the surface of the transfer belt becomes a flat state, and thus poor cleaning is unlikely to occur.

<Image Forming Device>

Figure 18:
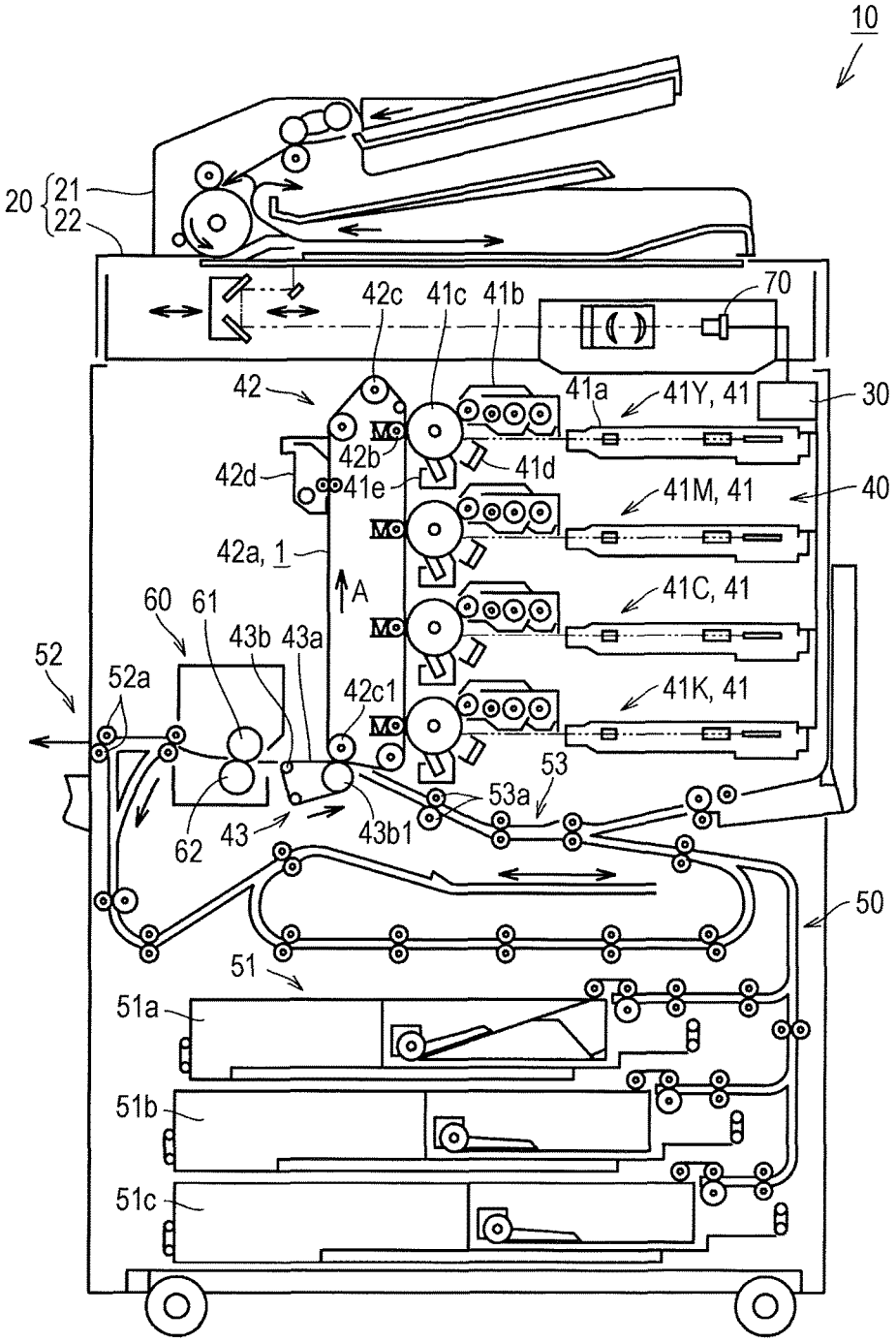
FIG. 18 is a schematic view of an image forming device according to an embodiment of the present invention.

FIG. 18 is a schematic view of the image forming device according to the present embodiment. Hereinafter, an image forming device 10 according to the present embodiment will be described with reference to FIG. 18. The image forming device 10 illustrated in FIG. 18 is a so-called digital multifunction peripheral.

The image forming device 10 according to the present embodiment is equipped with the transfer belt 1 according to the present embodiment as an intermediate transfer belt 42*a*, but the transfer belt 1 is used in basically the same use form as the use example described above with reference to FIG. 2.

The image forming device 10 includes an image reading section 20, an image processing section 30, an image forming section 40, a sheet conveying section 50, and a fixing device 60 as illustrated in FIG. 18.

The image forming section 40 has image forming units 41 (41Y, 41M, 41C, and 41K) that form images by respective color toners of Y (yellow), M (magenta), C (cyan), and K (black). The image forming units 41 have the same configuration except for an accommodated toner, and thus a reference numeral indicating a color is hereinafter omitted. The image forming section 40 further has an intermediate transfer unit 42 and a secondary transfer unit 43.

The image forming unit 41 includes an exposing device 41*a*, a developing device 41*b*, a photosensitive element drum 41*c*, a charging device 41*d*, and a drum cleaning device 41*e*. The surface of the photosensitive element drum 41*c* has photoconductivity and is, for example, a negative charging type organic photosensitive element. The photosensitive element drum 41*c* is an image carrier that carries the toner image.

The charging device 41*d* is, for example, a corona charger but may be a contact charging device that causes the photosensitive element drum 41*c* to contact and charge a contact charging member such as a charging roller, a charging brush, or a charging blade. The exposing device 41*a* is configured with, for example, a semiconductor laser.

The developing device 41*b* is, for example, a developing device of a two-component development scheme but may be a developing device of a one-component development scheme including no carrier.

The intermediate transfer unit 42 includes an intermediate transfer belt 42*a* configured with the transfer belt 1 according to the present embodiment, a primary transfer roller 42*b* that brings the intermediate transfer belt 42*a* to come into press-contact with the photosensitive element drum 41*c*, a plurality of support rollers 42*c* including an opposite roller 42*c*1, and a belt cleaning device 42*d*. The intermediate transfer belt 42*a* is an endless transfer belt. Here, the primary transfer section is mainly configured with by the primary transfer roller 42*b*.

The intermediate transfer belt 42*a* is stretched in a loop form through a plurality of support rollers 42*c* and is movable. As at least one driving roller of a plurality of support rollers 42*c* rotates, the intermediate transfer belt 42*a* moves in a direction of an arrow A at a constant speed.

The secondary transfer unit 43 includes an endless secondary transfer belt 43*a* and a plurality of support rollers 43*b* including a secondary transfer roller 43*b*1. The secondary transfer belt 43*a* is stretched in a loop form through the secondary transfer roller 43*b*1 and the support roller 43*b*. Here, the secondary transfer section is mainly configured with the secondary transfer roller 43*b*1 and the opposite roller 42*c*1.

The fixing device 60 includes a fixing roller 61 that heats and melts the toner on a sheet serving as recording medium and a pressing roller 62 that presses the sheet toward the fixing roller 61.

The image reading section 20 includes an automatic document feeder 21 and an original image scanning device 22 (scanner). Of these, the original image scanning device 22 is provided with a contact glass, various kinds of lens systems, and a CCD sensor 70. Further, the CCD sensor 70 is coupled to the image processing section 30.

The sheet conveying section 50 includes a sheet feeding section 51, an ejecting section 52, and a conveyance path section 53. Sheets (standard sheets and special sheets) identified on the basis of a basis weight, size, or the like are accommodated in sheet feed tray units 51*a* to 51*c* constituting the sheet feeding section 51 for each type which is set in advance. The conveyance path section 53 includes a plurality of pairs of conveying rollers such as a pair of resist rollers 53*a*. The ejecting section 52 is configured with an ejecting roller 52*a*.

Next, an image forming process performed by the image forming device 10 will be described. The original image scanning device 22 optically scans and reads a document on the contact glass. Reflected light from the document is read by the CCD sensor 70 and serves as input image data. The input image data is subjected to predetermined image processing in the image processing section 30 and transferred to the exposing device 41*a*. The input image data may be transferred from an external personal computer, a mobile device, or the like to the image forming device 10.

The photosensitive element drum 41*c* rotates at a constant circumferential speed. The charging device 41*d* uniformly charges the surface of the photosensitive element drum 41*c* to have a negative polarity. The exposing device 41*a* irradiates the photosensitive element drum 41*c* with laser light corresponding to the input image data of respective color component, and forms an electrostatic latent image on the surface of the photosensitive element drum 41*c*. The developing device 41*b* causes the toner to be adhered to the surface of the photosensitive element drum 41*c* and visualizes the electrostatic latent image on the photosensitive element drum 41*c*. Accordingly, the toner image according to the electrostatic latent image is formed on the surface of the photosensitive element drum 41*c*.

The toner image on the surface of the photosensitive element drum 41*c* is transferred onto the intermediate transfer belt 42*a* through the intermediate transfer unit 42. A transfer residual toner remaining on the surface of the photosensitive element drum 41*c* after the transfer is removed through the drum cleaning device 41*e* including the drum cleaning blade that comes into sliding contact with the surface of the photosensitive element drum 41*c*. The intermediate transfer belt 42*a* is brought into pressure contact with the photosensitive element drum 41*c* through the primary transfer roller 42*b*, and thus the toner images of the respective colors are sequentially transferred onto the intermediate transfer belt 42*a* in a superimposed manner.

The secondary transfer roller 43*b*1 is brought into press-contact with the opposite roller 42*c*1 with the intermediate transfer belt 42*a* and the secondary transfer belt 43*a* interposed therebetween. Accordingly, a transfer nip is formed. The sheet is conveyed to the transfer nip through the sheet conveying section 50 and then passes through the transfer nip. Correction of an inclination of the sheet and an adjustment of a conveyance timing are performed through a resist roller section provided with a pair of resist rollers 53*a*.

When the sheet is conveyed to the transfer nip, a transfer bias is applied to the secondary transfer roller 43*b*1. When the transfer bias is applied, the toner image carried on the intermediate transfer belt 42*a* is transferred onto the sheet. The transfer residual toner remaining on the surface of the intermediate transfer belt 42*a* is removed through the belt cleaning device 42*d* including the belt cleaning blade that comes into sliding contact with the surface of the intermediate transfer belt 42*a*. The belt cleaning device 42*d* may employ a cleaning method using a brush as long as it cleans the residual toner on the intermediate transfer belt 42*a*. Further, when the toner having a high transfer rate is used, the cleaning device may not be used. The sheet onto which the toner image is transferred is conveyed toward the fixing device 60 through the secondary transfer belt 43*a*.

The fixing device 60 heats and presses the sheet that has been undergone the transfer of the toner image and then conveyed in the nip section. Accordingly, the toner image is fixed to the sheet. The sheet onto which the toner image is fixed is ejected to the outside through the ejecting section 52 equipped with the ejecting roller 52*a*.

In the present embodiment described above, the example in which the present invention is applied to a so-called digital multifunction peripheral and an intermediate transfer belt installed therein as an image forming device and a transfer belt has been described, but it will be appreciated that the present invention can be applied to any other image forming device and a transfer belt installed therein.

<Image Forming Device>

Figure 19:
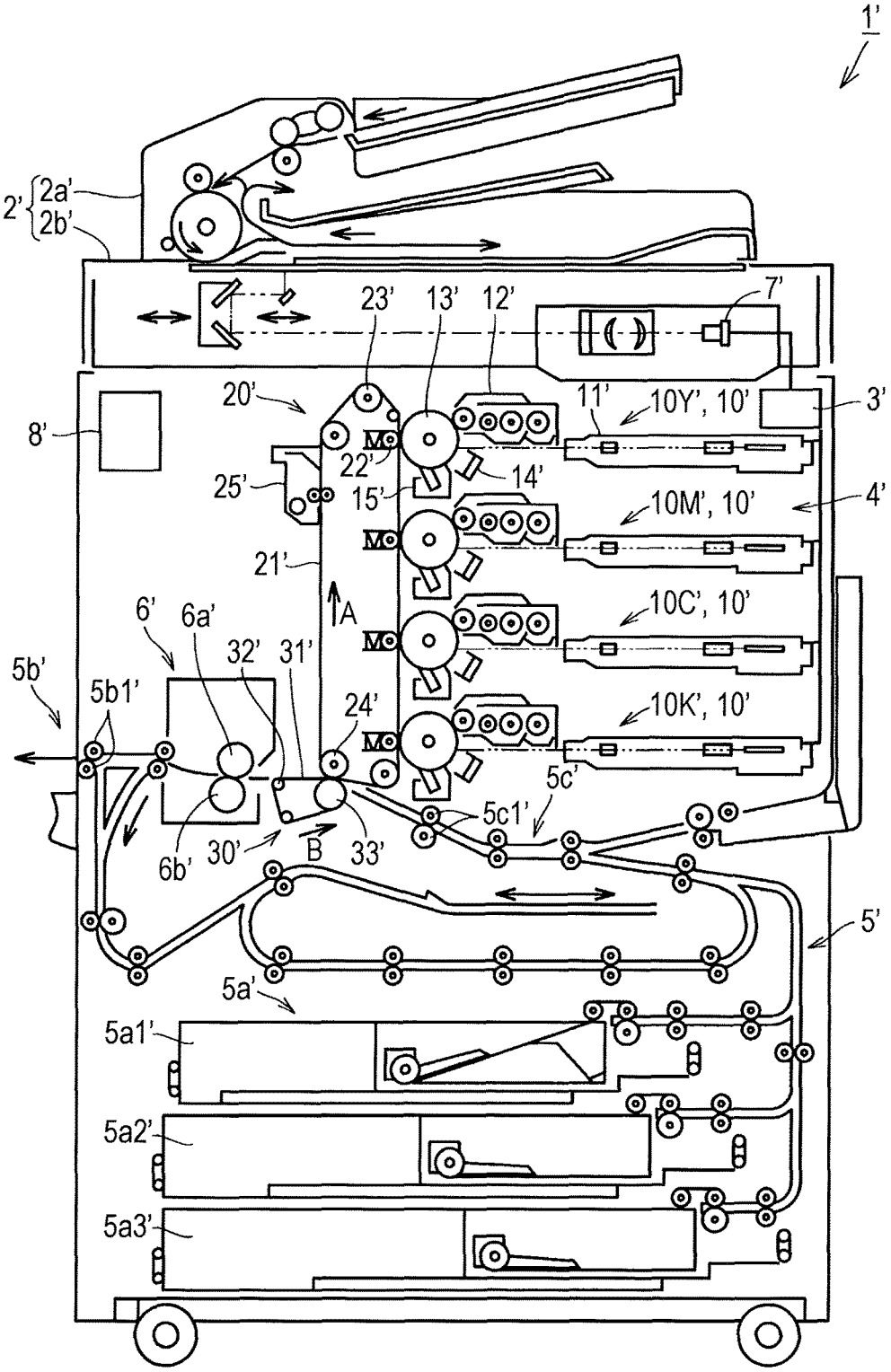
FIG. 19 is a schematic view of an image forming device according to an embodiment of the present invention.
Figure 20:
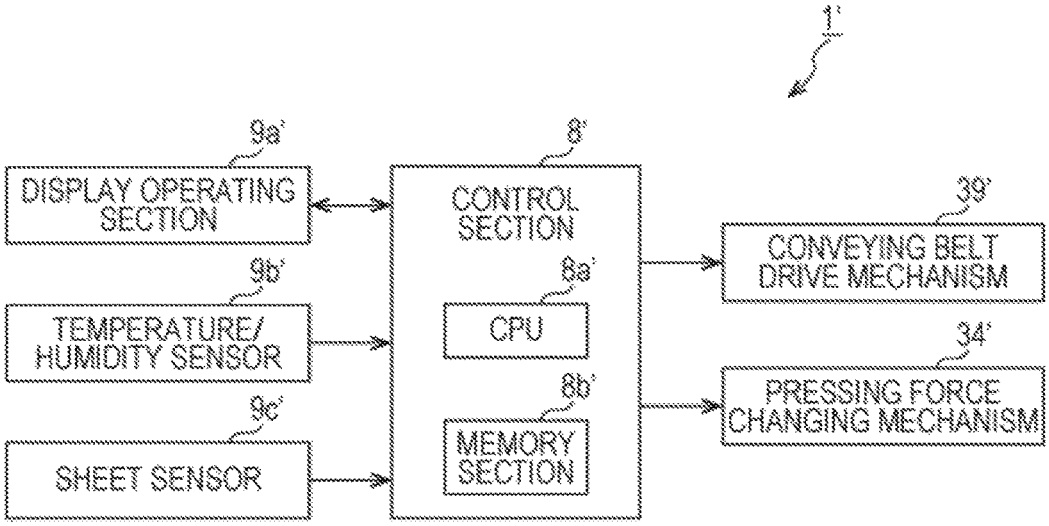
FIG. 20 is a view illustrating a configuration of main functional blocks of the image forming device illustrated in FIG. 19.
Figure 21:
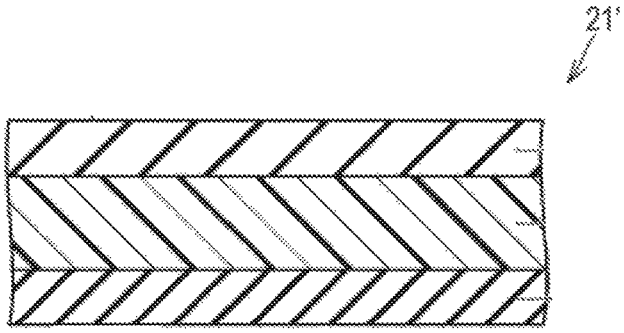
FIG. 21 is a cross-sectional view of a transfer belt illustrated in FIG. 19.
Figure 22:
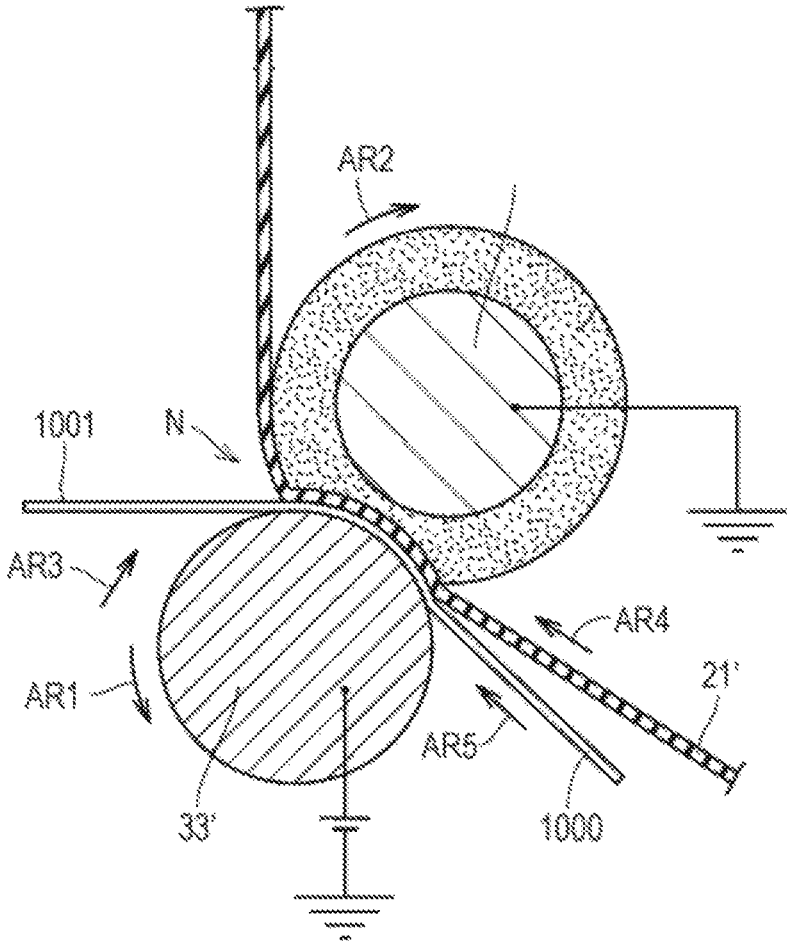
FIG. 22 is a schematic cross-sectional view of a secondary transfer section illustrated in FIG. 19.
Figure 23A:
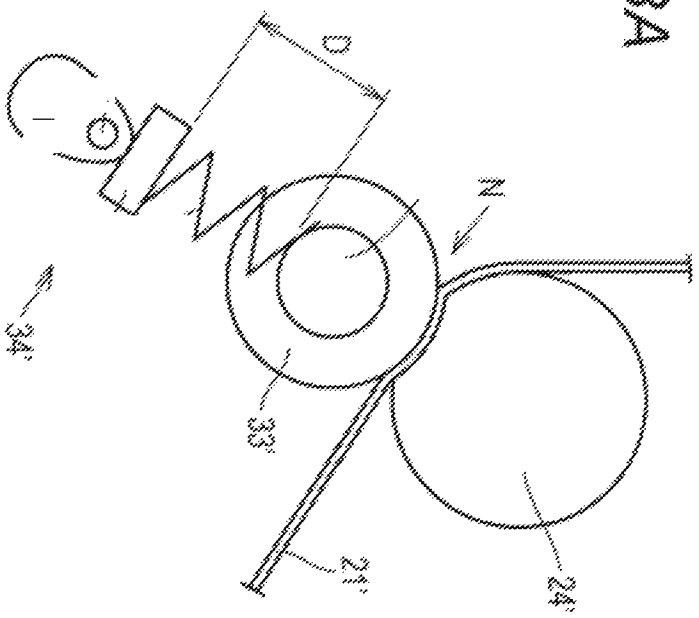
FIGS. 23A and 23B are schematic views illustrating a pressing force changing mechanism of the image forming device illustrated in FIG. 19.
Figure 23B:
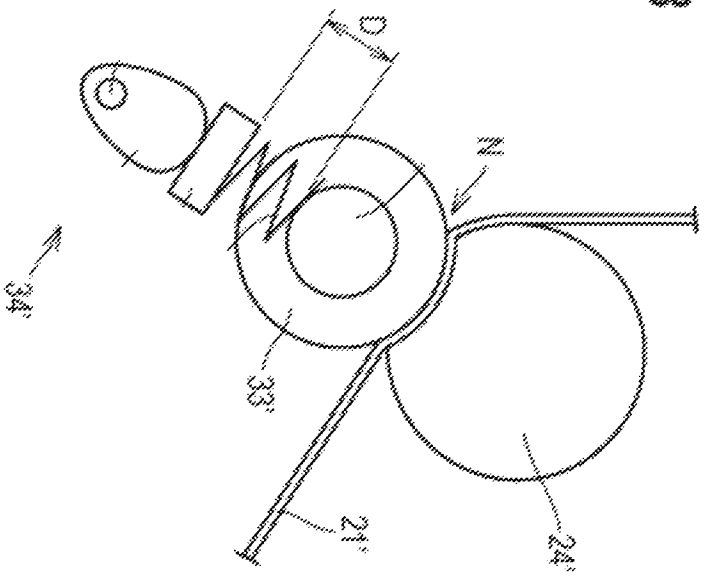
Figure 24:
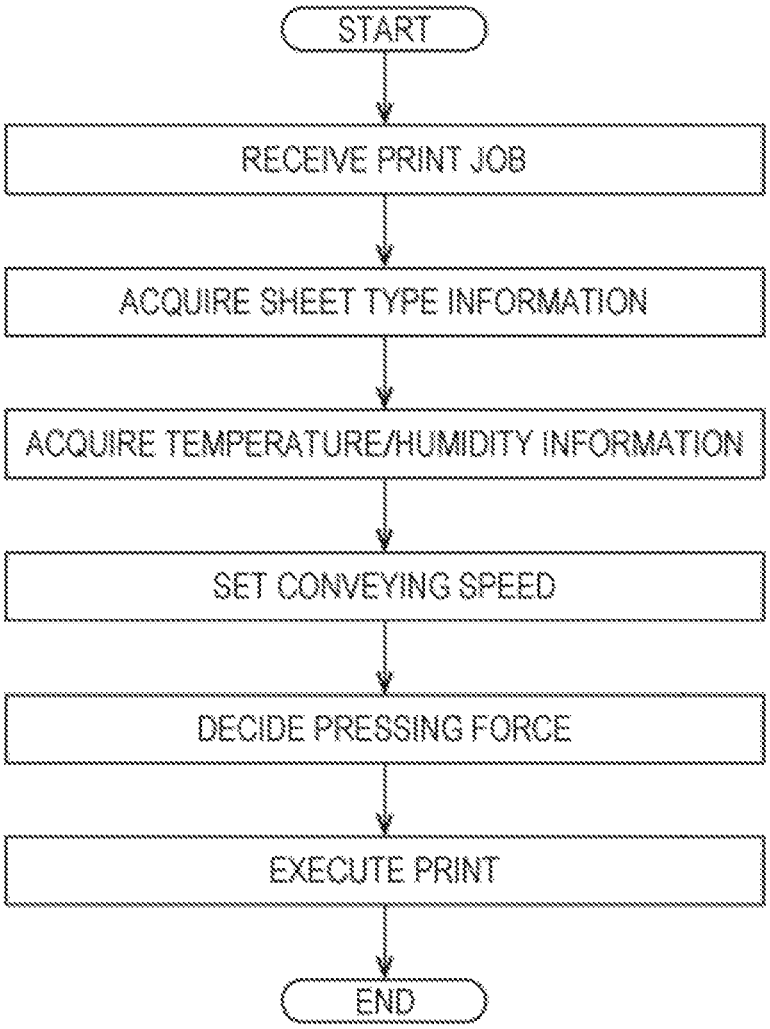
FIG. 24 is a view illustrating an image forming flow of the image forming device illustrated in FIG. 19.
Figures 25, 26:
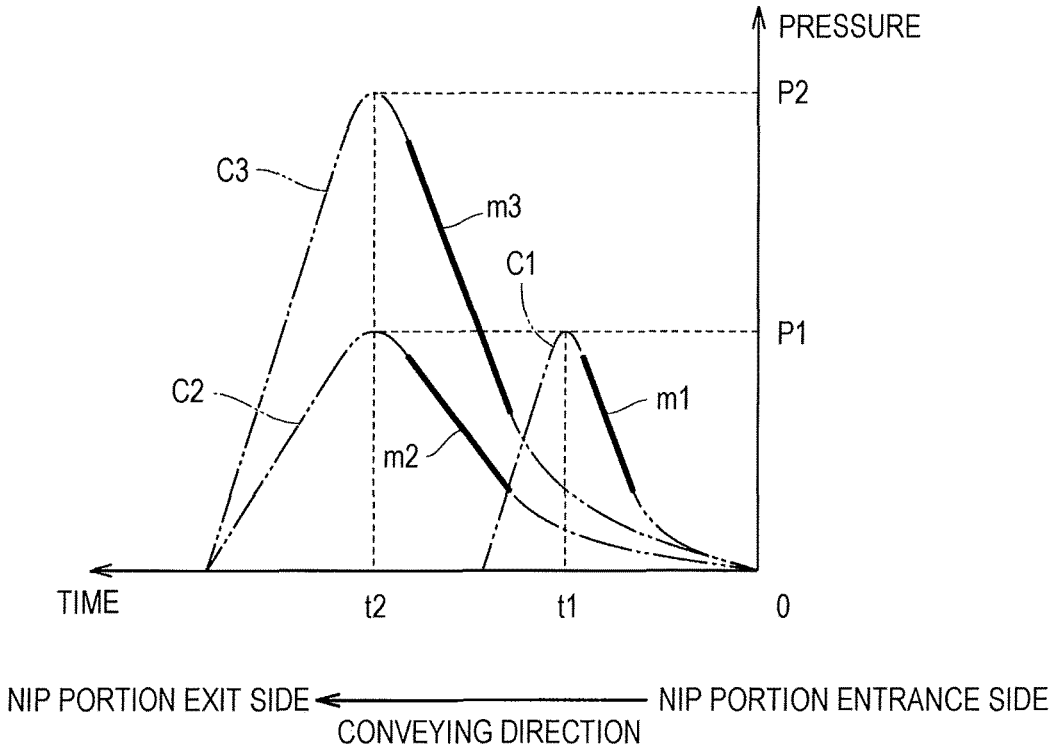
FIG. 25 is a view illustrating an example of a pressing force setting table included in the image forming device illustrated in FIG. 19.
FIG. 26 is a graph illustrating a temporal change in pressure applied to a point on a transfer belt in a secondary transfer section in the image forming device illustrated in FIG. 19.

FIG. 19 is a schematic view of an image forming device according to an embodiment of the present invention, and FIG. 20 is a view illustrating a configuration of major functional blocks of the image forming device illustrated in FIG. 19. First, an image forming device 1' according to the present embodiment will be described with reference to FIGS. 19 and 20. The image forming device 1' according to the present embodiment is a so-called digital multifunction peripheral.

As illustrated in 19, the image forming device 1' mainly includes an image reading section 2', an image processing section 3', an image forming section 4', a sheet conveying section 5', a fixing section 6', a CCD sensor 7', a control section 8', and the like.

The image reading section 2' includes an automatic document feeder 2*a*' and an original image scanning device 2*b*' (scanner). Of these, the original image scanning device 2*b*' is provided with a contact glass, various kinds of lens systems, and a CCD sensor 7'. Further, the CCD sensor 7' is coupled to the image processing section 3'. The image processing section 3' performs predetermined image processing on an input image.

The image forming section 4' has image forming units 10' (10Y', 10M', 100', and 10K') that form images by respective color toners of Y (yellow), M (magenta), C (cyan), and K (black). The image forming units 10' have the same configuration except for an accommodated toner, and thus a reference numeral indicating a color is hereinafter omitted. The image forming section 4' further includes an intermediate transfer unit 20' and a secondary transfer unit 30'.

The image forming unit 10' includes an exposing device 11', a developing device 12', a photosensitive element drum 13', a charging device 14', and a drum cleaning device 15'. The surface of the photosensitive element drum 13' has photoconductivity and is, for example, a negative charging type organic photosensitive element. The photosensitive element drum 13' is an image carrier that carries the toner image.

The charging device 14' is, for example, a corona charger but may be a contact charging device that causes the photosensitive element drum 13' to contact and charge a contact charging member such as a charging roller, a charging brush, or a charging blade. The exposing device 11' is configured with, for example, a semiconductor laser.

The developing device 12' is, for example, a developing device of a two-component development scheme but may be a developing device of a one-component development scheme including no carrier.

The intermediate transfer unit 20' includes a transfer belt 21', a primary transfer roller 22' that brings the transfer belt 21' into press-contact with the photosensitive element drum 13', a plurality of support rollers 23', an opposite roller 24', and a belt cleaning device 25'. The transfer belt 21' is an endless belt. Here, the primary transfer section that transfers the toner image carried on the photosensitive element drum 13' onto the transfer belt 21' is mainly configured with the primary transfer roller 22'.

The transfer belt 21' is stretched in a loop form through a plurality of support rollers 23' and the opposite roller 24' and is movable. As at least one driving roller of a plurality of support rollers 23' and the opposite roller 24' rotates, the transfer belt 21' moves in a direction of an arrow A.

The secondary transfer unit 30' includes a conveying belt 31', a plurality of support rollers 32', and a secondary transfer roller 33'. The conveying belt 31' is an endless belt. Here, the secondary transfer section which transfers the toner image carried on the transfer belt 21' onto the recording medium by pinching and pressing the transfer belt 21' and the recording medium mainly with the secondary transfer roller 33' and the opposite roller 24' is configured.

The conveying belt 31' is stretched in a loop form through a plurality of support rollers 32' and the secondary transfer roller 33' and is movable. As at least one driving roller of a plurality of support rollers 32' and the secondary transfer roller 33' rotates, the conveying belt 31' moves in a direction of an arrow B. A driving roller and a driving source for driving the driving roller constitute a conveying belt drive mechanism 39' to be described later (see FIG. 19).

The fixing section 6' fixes the toner image transferred onto the recording medium to the recording medium and includes a fixing roller **6*a*' that heats and melts the toner on the sheet serving as the recording medium and a pressing roller 6*b*' that presses the sheet toward the fixing roller 6*a*'**.

The sheet conveying section 5' includes a sheet feeding section **5*a*', an ejecting section 5*b*', and a conveyance path section 5*c*'. Sheets identified on the basis of a basis weight, size, or the like are accommodated in sheet feed tray units 5*a*1' to 5*a*3' constituting the sheet feeding section 5*a*' for each type which is set in advance. The conveyance path section 5*c*' includes a plurality of conveying roller pairs such as a pair of resist rollers 5*c*1'. The ejecting section 5*b*' is configured with an ejecting roller 5*b*1'. The conveying belt 31' constitutes the conveyance path section 5*c*' of the portion positioned between the secondary transfer section and the fixing section 6'**.

Here, the conveying speed of the sheet in the conveyance path section **5*c*' is decided by the control section 8' as will described later. The conveyance path section 5*c*' includes a motor, a motor driver, a gear, and the like in addition to the conveying belt 31' and a plurality of conveying roller pairs, and a component for driving the conveying belt 31' corresponds to a conveying belt drive mechanism 39'. The plurality of pairs of conveying rollers, the motor, the motor driver, the gear, and the like convey the sheet by receiving an electric signal from the control section 8'** and rotating various kinds of motors.

The members rotated by various kinds of motors include a developing roller included in the developing device 12', the photosensitive element drum 13', the transfer belt 21', the secondary transfer roller 33', the fixing roller **6*a*', a pair of conveying rollers, but the members may be unitarily driven by one motor or may be separately driven by a plurality of motors. However, it is desirable that outer peripheral surfaces of the members be driven at the same linear speed (the linear velocity is generally referred to as a "system speed"). The control section 8'** can change the system speed by switching revolutions of various kinds of motors or a gear.

In the present embodiment, the conveying belt 31' and the conveying belt drive mechanism 39' for driving the conveying belt 31' are used as a unit for conveying the sheet between the secondary transfer section and the fixing section 6', but this unit may be configured with any unit as long as it can carry the sheet from the secondary transfer section to the fixing section 6'. For example, instead of using the belt, the unit may be configured with a pair of conveying rollers for conveying the sheet and a conveying roller pair drive mechanism for driving a pair of conveying rollers or may be configured with the secondary transfer roller 33', the opposite roller 24', and a roller drive mechanism for driving the secondary transfer roller 33' and the opposite roller 24' so that the sheet is conveyed directly to the fixing section 6' through the secondary transfer roller 33' and the opposite roller 24'.

The control section 8' is a unit that controls the image forming device 1' in general and includes a processor such as a central processing unit (CPU) **8*a*' and a memory section 8*b*' such as a read only memory (ROM) and a random access memory (RAM) as main components as illustrated in FIG. 20. Typically, the CPU 8*a*' executes various kinds of programs stored in the memory section 8*b*' and performs, for example, a process related to image forming in the image forming device 1'**.

The image forming device 1' further includes a display operating section **9*a*', a temperature/humidity sensor 9*b*', a sheet sensor 9*c*', and a pressing force changing mechanism 34' in addition to the above-described configuration as illustrated in FIG. 20**.

The display operating section **9*a*' is a unit that displays, for example, a state of the image forming device 1' for the user on the basis of a command of the control section 8', receives an operation of the user on the image forming device 1' and inputs the operation to the control section 8'**.

The temperature/humidity sensor **9*b*' functions to detect temperature and humidity inside or around the image forming device 1' and input the temperature and the humidity to the control section 8'**.

The sheet sensor **9*c*'** is a recording medium type information acquiring unit that acquires a recording medium type, and more specifically, is a unit that identifies whether a recording medium type used for image forming is a plain sheet or an embossed sheet or a degree of a concave portion depth of the embossed sheet when the recording medium type is the embossed sheet, and acquires the recording medium type as information.

For example, the sheet sensor **9*c*' is configured with an optical sensor capable of detecting a magnitude of the concave-convex portion on the surface of the sheet accommodated in the sheet feeding section 5*a*'. In this case, the sheet sensor 9*c*' includes a light emitting element configured with, for example, a light emitting diode which obliquely irradiates the surface of the sheet with visible light or infrared light and an light receiving element configured with, for example, a photodiode which receives reflected light from the surface of the sheet, detects the concave portion depth according to the amount of reflected light received from the sheet, and outputs a detection result to the control section 8'. The control section 8'** acquires the recording medium type on the basis of the detection result.

The sheet sensor **9*c*' is not limited to the use of the optical sensor described above, but any other type of sensor capable of identifying the recording medium type may be used. Further, the recording medium type information acquiring unit is not limited to the use of the sheet sensor 9***c*' described above, and the control section 8' may acquire the recording medium type by designating the recording medium type accommodated in the sheet feeding section 5*a*' through the display operating section 9*a*' or the like.

The pressing force changing mechanism 34' is a mechanism for changing the pressing force to be applied to the transfer belt 21' and the sheet in the secondary transfer section, and is attached to, for example, the secondary transfer roller 33', and the details thereof will be described later.

Here, in the image forming device 1' according to the present embodiment, the control section 8' receives inputs from the display operating section 9*a*', the temperature/humidity sensor 9*b*', the sheet sensor 9*c*', and the like, decides an optimal image forming condition, sets the speed for conveying the sheet through the conveying belt drive mechanism 39' on the basis of the optimal image forming condition, and controls the operation of the pressing force changing mechanism 34' such that the pressing force to be applied to the transfer belt 21' and the sheet in the secondary transfer section is adjusted, and the details thereof will be described later.

Next, an image forming process performed by the image forming device 1' will be described. The original image scanning device 2*b*' optically scans and reads a document on the contact glass. Reflected light from the document is read by the CCD sensor 7' and serves as input image data. The input image data is subjected to predetermined image processing in the image processing section 3' and transferred to the exposing device 11'. The input image data may be transferred from an external personal computer, a mobile device, or the like to the image forming device 1'.

The photosensitive element drum 13' rotates at a constant circumferential speed. The charging device 14' uniformly charges the surface of the photosensitive element drum 13' to have a negative polarity. The exposing device 11' irradiates the photosensitive element drum 13' with laser light corresponding to the input image data of respective color component, and forms an electrostatic latent image on the surface of the photosensitive element drum 13'. The developing device 12' causes the toner to be adhered to the surface of the photosensitive element drum 13' and visualizes the electrostatic latent image on the photosensitive element drum 13'. Accordingly, the toner image according to the electrostatic latent image is formed on the surface of the photosensitive element drum 13'.

The toner image on the surface of the photosensitive element drum 13' is transferred onto the transfer belt 21' through the intermediate transfer unit 20'. A transfer residual toner remaining on the surface of the photosensitive element drum 13' after the transfer is removed through the drum cleaning device 15' including the drum cleaning blade that comes into sliding contact with the surface of the photosensitive element drum 13'. The transfer belt 21' is brought into press-contact with the photosensitive element drum 13' through the primary transfer roller 22', and thus the toner images of the respective colors are sequentially transferred onto the transfer belt 21' in a superimposed manner.

The secondary transfer roller 33' is brought into press-contact with the opposite roller 24' with the transfer belt 21' and the conveying belt 31' interposed therebetween. Accordingly, a transfer nip is formed. The sheet is conveyed to the transfer nip through the sheet conveying section 5' and then passes through the transfer nip. Correction of an inclination of the sheet and an adjustment of a conveyance timing are performed through a resist roller section provided with a pair of resist rollers 5*c*1'.

When the sheet is conveyed to the transfer nip, a transfer bias is applied to the secondary transfer roller 33'. When the transfer bias is applied, the toner image carried on the transfer belt 21' is transferred onto the sheet. The transfer residual toner remaining on the surface of the transfer belt 21' is removed through the belt cleaning device 25' including the belt cleaning blade that comes into sliding contact with the surface of the transfer belt 21'. The belt cleaning device 25' may employ a cleaning method using a brush as long as it cleans the residual toner on the transfer belt 21'. Further, when the toner having a high transfer rate is used, the cleaning device may not be used. The sheet onto which the toner image is transferred is conveyed toward the fixing section 6' through the conveying belt 31'.

The fixing section 6' heats and presses the sheet that has been undergone the transfer of the toner image and then conveyed in the nip section. Accordingly, the toner image is fixed to the sheet. The sheet onto which the toner image is fixed is ejected to the outside through the ejecting section 5*b*' equipped with the ejecting roller 5*b*1'.

Here, the toner is prepared by causing a coloring agent or a charge control agent, a release agent, or the like as necessary to be contained in binder resin and treating an external additive, and a well-known toner which is commonly used can be used. A volume average particle diameter of the toner is preferably in a range of 2 [μm] to 12 [μm], and more preferably, in a range of 3 [μm] to 9 [μm] in terms of an image quality.

A shape factor SF-1 of the toner is preferably 100 to 140 but not necessarily limited to this range.

The shape factor SF-1 is obtained by capturing 100 toners randomly photographed at 5000 times by a scanning electron microscope through a scanner, performing analysis using an image processing analysis device "Luzex AP" (available from Nireco Corporation), and obtaining an average value of shape factors (SF-1) derived by the following Formula:

$$\text{SF-1}=[\{(\text{absolute maximum length of particles})^2/(\text{projection area of particles})\}\times(\pi/4)]\times 100$$

Fine particles of a metal oxide such as silica or titania are used as the external additive of the toner, and particles having a relatively large diameter such as 100 [nm] as well as particles having a small diameter such as 30 [nm] are used. For the purpose of powder fluidity, charge control, and the like, inorganic fine particles having an average primary particle size of 40 [nm] or less may be used. Further, in order to reduce the adhesion force, inorganic or organic fine particles having a larger diameter may be used together as necessary. As the inorganic fine particles, in addition to silica or titania, alumina, a metatitanic acid, zinc oxide, zirconia, magnesia, calcium carbonate, magnesium carbonate, calcium phosphate, cerium oxide, strontium titanate, or the like can be used. In order to improve dispersibility and powder fluidity, the surface of the inorganic fine particles may be separately treated.

The carrier is not particularly limited, and a well-known carrier which is commonly used may be used, and a binder type carrier or a coated type carrier may be used. The carrier particle size is not limited to this example but preferably 15 [μm] or more and 100 [μm] or less.

<Method of Deciding Pressing Force Setting Table>

Figure 27A:
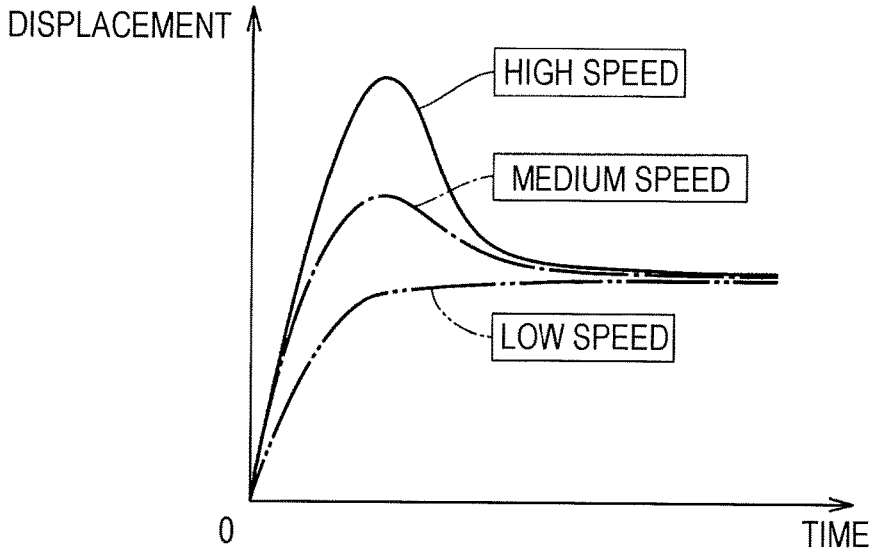
FIGS. 27A and 27B are a graph illustrating a change in behavior of displacement of a measurement region of a belt when a pressing speed is changed in the belt showing the first pattern illustrated in FIG. 7 and a graph illustrating a relation between a pressing speed and an overshoot rate E.
Figure 27B:
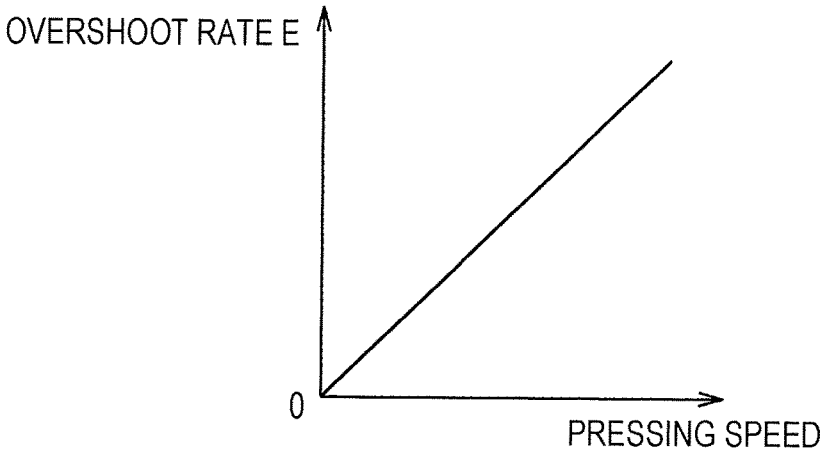
Figure 28A:
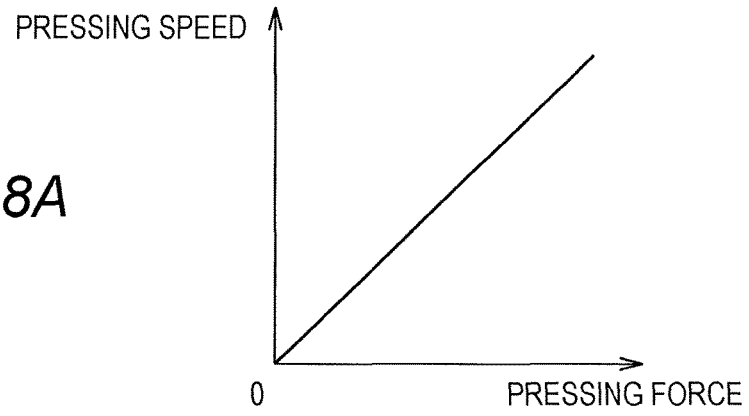
FIGS. 28A to 28C are various graphs for describing a specific decision method of a pressing force setting table.
Figure 28B:
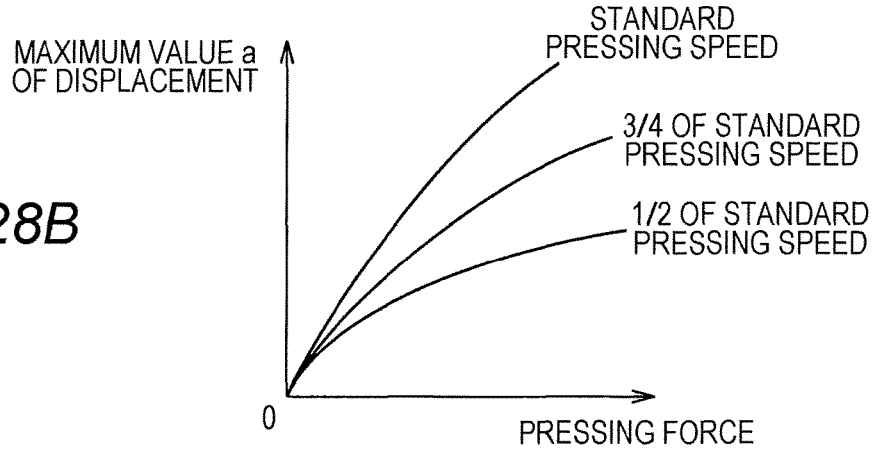
Figure 28C:
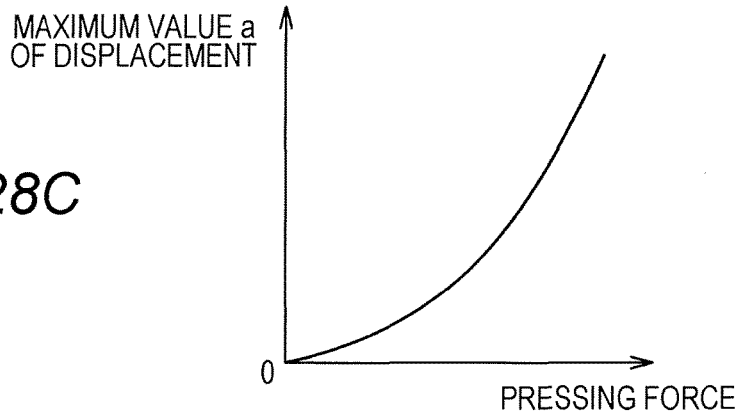

FIG. 27A is a graph illustrating a change in the behavior of displacement of the belt measurement region when the pressing speed is changed in the belt showing the first pattern illustrated in FIG. 7, and FIG. 27B is a graph illustrating a relation between the pressing speed and the overshoot rate E. FIGS. 28A to 28C are various kinds of graphs for describing a specific method of deciding a pressing force setting table. Then, a specific method of deciding the pressing force setting table will be described with reference to FIGS. 27A to 28C.

As illustrated in FIG. 27A, even in the case of the belt showing the first pattern illustrated in FIG. 7, there is a big difference in the transition of the displacement of the first main surface Sa of the belt S due to the pressing speed. In other words, when the pressing speed is a high speed, the displacement converges to a value which is attenuated after the peak value, but when the pressing speed is a medium speed, the peak value is small, and when the pressing speed is a low speed, it gradually increases and converges without having the peak value.

Here, the maximum value a of the displacement of the first main surface Sa of the belt S is largely related to the magnitude of the follow-up deformation effect. For this reason, when the pressing speed is a high speed, the maximum value a of the displacement of the first main surface Sa of the belt S is sufficiently large, the follow-up deformation effect increases, and when the pressing speed is a medium speed, the maximum value a of the displacement of the first main surface Sa of the belt S is slightly large, and the follow-up deformation effect is correspondingly obtained, and when the pressing speed is a low speed, the maximum value a of the displacement of the first main surface Sa of the belt S coincides with the convergence value, and the follow-up deformation effect is small.

Further, as described above, the transition of the displacement of the first main surface Sa of the belt S is largely related to the adhesion force reduction effect. For this reason, when the pressing speed is a high speed, the adhesion force reduction effect increases since the surface Sa of the belt S is complicatedly deformed at a high speed, and when the pressing speed is a medium speed, the adhesion force reduction effect is correspondingly obtained since the surface Sa of the belt S is slightly complicatedly deformed, and when the pressing speed is a low speed, little adhesion force reduction effect is obtained since the surface of belt S is simply deformed at a low speed.

As a result of examining the relation between the pressing speed and the above overshoot rate E, it was found that it has a substantially linear relation as illustrated in FIG. 27B. Therefore, the overshoot rate E largely depends on the pressing speed, and the overshoot rate E tends to decrease as the pressing speed decreases.

On the other hand, the relation between the pressing force and the pressing speed of the secondary transfer section in the image forming device 1' is a linear relation as illustrated in FIG. 28A. Therefore, when the conveying speed of the recording medium is a low speed, it is desirable to increase the pressing force to prevent the pressing speed from being too slow.

Here, FIG. 28B illustrates a relation between the pressing force and displacement a of the first main surface Sa of the belt S which is examined using the displacement measuring device 100 for each pressing speed. As described above, the displacement of the first main surface Sa of the belt S is increased as the pressing force increases and further increased as the pressing speed increases.

Further, as illustrated in FIG. 28C, in the relation between the pressing force in the secondary transfer section and the displacement a of the first main surface Sa of the belt S, the displacement a of the first main surface Sa of the belt S with respect to the pressing force in the secondary transfer section has a non-linear relation which is illustrated in FIG. 28C. This is because the pressing force and the pressing speed increase simultaneously as the pressing force in the secondary transfer section increases.

Therefore, it is desirable that the pressing force in the secondary transfer section when the conveying speed is lower than a standard conveying speed be set so that the processing speed at which the overshoot rate E can secure an appropriate value is set, and the maximum value a of the displacement of the first main surface Sa of the belt S becomes the same level as in the case of the standard conveying speed with reference to the graph of the relation between the pressing speed and the overshoot rate E and the graph of the relation between the pressing force in the secondary transfer section and the maximum value a of the displacement of the first main surface Sa of the belt S.

In the pressing force setting table, the relation between the conveying speed of the recording medium and the pressing force in the secondary transfer section may be decided in advance for each recording medium type, and in this case, the control section 8' decides the pressing force with reference to the pressing force setting table according to the recording medium type from a plurality of pressing force setting tables.

Further, in the pressing force setting table, the relation between the recording medium type and the pressing force in the secondary transfer section may be decided in advance for each conveying speed of the recording medium, and in this case, the control section 8' decides the pressing force with reference to the pressing force setting table according to the conveying speed of the recording medium from a plurality of pressing force setting tables.

As described above, when the image forming device 1' according to the present embodiment is employed, the pressing force in the secondary transfer section is decided in accordance with the acquired recording medium type and the set conveying speed of the recording medium, and thus it is possible to implement the high transfer property even for the recording medium having the concave-convex portions on the surface. Further, when the above configuration is employed, as can be understood from results of an example, the first and second comparative examples, and the like to be described later, it is possible to implement the image forming device capable of suppressing the deterioration in the image grade although it is repeatedly used.

Example

In an example, an image forming device (digital multifunction peripheral: bizhub PRESS C 6000) available from Konica Minolta was used, the transfer belt installed in the image forming device was replaced with the belt showing the first pattern illustrated in FIG. 7, and image forming was actually performed by variously changing the conveying speed of the embossed sheet using a plurality of types of embossed sheets that differ in the concave portion depth. In the belt used in the present example, a material of the base layer is polyimide, a material of the elastic layer is nitrile rubber, a thickness of the base layer is 80 [μm], and a thickness of the elastic layer is 200 [μm].

FIG. 29 is a view illustrating the pressing force setting table used in the example. In the pressing force setting table, the pressing force in the secondary transfer section is obtained so that the satisfactory transfer property is obtained for embossed sheets having various kinds of concave portion depths Δd [μm] at the standard conveying speed (400 [mm/ms]) of the recording medium on the basis of the method of deciding the pressing force setting table, and the pressing force in the secondary transfer section is decided so that the displacement of the first main surface of the belt having the same level as in the case of the standard conveying speed of the recording medium is obtained even when the conveying speed of the recording medium is slow.

In the present example, on the basis of each of a total of nine conditions set in the pressing force setting table, it was confirmed whether the transfer property to the concave portion of the embossed sheet is good or bad, and the presence or absence of the occurrence of the image noise after 10,000 sheets are printed was confirmed to verify durability of the belt.

(Whether Transfer Property is Good or Bad)

In order to confirm whether the transfer property is good or bad, an embossed sheet made by Special Tokai Paper Co., Ltd., a trade name LESAC 66 (LESAC is a registered trademark), was used. Basis weights of the embossed sheets are 302 [g/m$^2$], 203 [g/m$^2$], 151 [g/m$^2$], and 116 [g/m$^2$], and the concave portion depth differs depending on the basis weight as well. An image to be formed was a solid image. At the time of determination, reflected density of a sharp concave portion having a large depth and reflected density of a convex portion were measured using a microdensitometer, and a density differences was calculated. "Good" was determined when the density difference is less than 0.25, "acceptable" was determined when the density difference is 0.25 or more and less than 0.40, and "bad" was determined when the density difference is 0.40 or more.

(Presence or Absence of Occurrence of Image Noise)

The presence or absence of the occurrence of an image noise was confirmed by printing 10,000 sheets in which the basis weight of LESAC 66 (LESAC is a registered trademark) is 302 [g/m$^2$], then further printing a sold image through the same device, and observing an image quality of the solid image. Neither crack nor abrasion was observed in the transfer belt after printing 10,000 sheets. At the time of determination, "good" was determined when the transfer belt is neither cracked nor abraded, and an image has no noise, "acceptable" was determined when the transfer belt is cracked or abraded, but an image has no noise, and "bad" was determined when the transfer belt is cracked or abraded, and an image has a noise.

(Evaluation Results)

FIG. 30 is a table illustrating image evaluation results and measured values of the increase speed of the pressure in the example, and FIG. 31 illustrates a table showing a result of confirming the life span of the intermediate transfer belt in the example and the measured values of the increase speed of the pressure. The measured values of the increase speed of the pressure in the secondary transfer section illustrated in FIGS. 30 and 31 were measured by the following method.

First, a tactile sensor (a surface pressure distribution measurement system I-SCAN) available from Nitta Corporation was interposed between the secondary transfer roller and the transfer belt, the transfer belt was set to a stationary state and was brought into press-contact with the secondary transfer roller, and the pressure distribution was measured. Then, a maximum value P [kPa] of the pressure was obtained on the basis of the measured pressure distribution along the sheet conveying direction, and conveying direction positions x1 and x2 which are half (P/2) the maximum value P [kPa] (x1: an upstream side of the nip section, x2: a downstream side of the nip section) were obtained.

Here, when the conveying speed of the recording medium is indicated by Vsys [mm/s], and a nip width W [mm] is indicated by x1−x2, since the increase speed ΔP/Δt of the pressure is "ΔP/Δt=ΔP/Δx×Vsys," the increase speed of the pressure on the entrance side of the nip section is ΔP/Δt=(P/2)×Vsys/(W/2)×1000 [kPa/ms], and the increase speed of the pressure is calculated from this Formula.

As illustrated in FIG. 30, in the example, it was confirmed that the transfer property for the embossed sheet is satisfactory regardless of the used embossed sheet and the conveying speed of the embossed sheet.

Further, as illustrated in FIG. 31, in the example, it was confirmed that regardless of the used embossed sheet and the conveying speed of the embossed sheet, no image noise occurred after 10,000 sheets were printed, and the transfer belt had sufficient durability, and reliability could be secured.

On the basis of the above results, when the present invention is applied, it was experimentally confirmed that it is possible to implement the image forming device capable of achieving the high transfer property even for the recording medium having the concave-convex portions on the surface and suppressing degradation in the image grade by the repetitive use.

First Comparative Example

In a first comparative example, image forming was performed under similar conditions as in the example except that the pressing force setting table different from that of the example was used.

FIG. 32 is a view illustrating the pressing force setting table used in the first comparative example. In the pressing force setting table, the pressing force in the secondary transfer section was set so that the satisfactory transfer property is obtained for embossed sheet having various kinds of concave portion depths Δd [μm] at the standard conveying speed (400 [mm/ms]) of the recording medium, but unlike the above example, the same pressing force as in the case of the standard conveying speed of the recording medium was set even when the conveying speed of the recording medium is slow.

(Evaluation Results)

FIG. 33 is a table illustrating image evaluation results and measured values of the increase speed of the pressure in the first comparative example. The measured values of the increase speed of the pressure in the secondary transfer section illustrated in FIG. 33 were measured using a similar method to that of the above example.

As illustrated in FIG. 33, in the first comparative example, it was confirmed that the transfer property for the embossed sheet may deteriorate when the conveying speed of embossed sheet is slower than the standard conveying speed.

This is because, when the conveying speed of the embossed sheet decreases, the increase speed of the pressure with respect to the transfer belt decreases, and thus the expansion/contraction deformation of the surface of the transfer belt leading to the adhesion force reduction effect is unable to occur.

Second Comparative Example

In a second comparative example, image forming was performed under similar conditions as in the example except that the pressing force setting table different from that of the example was used.

FIG. 34 is a view illustrating the pressing force setting table used in the second comparative example. In the pressing force setting table, the pressing force in the secondary transfer section was set so that the satisfactory transfer property is obtained for embossed sheet having various kinds of concave portion depths Δd [μm] at a conveying speed (200 [mm/ms]) slower than the standard conveying speed of the recording medium, and the same pressing force as in the case of the conveying speed slower than the standard conveying speed of the recording medium was set even when the conveying speed of the recording medium is fast.

(Evaluation Results)

FIG. 35 is a table illustrating image evaluation results and measured values of the increase speed of the pressure in the second comparative example, and FIG. 36 is a table illustrating a result of confirming the life span of the intermediate transfer belt and the measured values of the increase speed of the pressure in the second comparative example. The measured values of the increase speed of the pressure in the secondary transfer section illustrated in FIGS. 35 and 36 were measured using a similar method to that of the above example.

As illustrated in FIG. 35, in the second comparative example, it was confirmed that the transfer property for the embossed sheet is satisfactory regardless of the used embossed sheet and the conveying speed of the embossed sheet.

On the other hand, as illustrated in FIG. 36, in the second comparative example, when the conveying speed of the embossed sheet is faster than the conveying speed which is slower than the standard conveying speed of the recording medium, an image noise occurred after 10,000 sheets were printed, and the transfer belt had no sufficient durability, and reliability was unable to be secured.

This is because, when the conveying speed of the embossed sheet increases, the increase speed of the pressure with respect to the transfer belt becomes too large, the surface of the transfer belt is excessively deformed, cracks occurs accordingly, the generated cracks are further increased, the edge of the concave portion of the embossed sheet and the transfer belt rub against each other, and thus the transfer belt is easily abraded.

<Relation Between Increase Speed of Pressure and Each of Transfer Property and Life Span>

FIG. 37 is a table illustrating a relation between the increase speed of the pressure and each of the transfer property and the life span. The table shows a result of performing an evaluation by variously changing a setting of the pressing force in addition to the evaluation results in the example and the first and second comparative examples.

As can be understood from FIG. 37, in the case of the embossed sheet in which the concave portion depth Δd [μm] of the recording medium is relatively small (30 [μm]≤Δd<50 [μm]), the transfer property and the life span are satisfactory when the increase speed ΔP/Δt [kPa/ms] of the pressure is 10 [kPa/ms]≤ΔP/Δt≤35 [kPa/ms].

Further, in the case of the embossed sheet in which the concave portion depth Δd [μm] of the recording medium is medium (50 [μm]≤Δd<70[μm]), the transfer property and the life span are satisfactory when the increase speed ΔP/Δt [kPa/ms] of the pressure is 11 [kPa/ms]ΔP/Δt≤35 [kPa/ms].

Further, in the case of the embossed sheet in which the concave portion depth Δd [μm] of the recording medium is relatively large (70[μm]≤Δd), the transfer property and the life span are satisfactory when the increase speed ΔP/Δt [kPa/ms] of the pressure is 15 [kPa/ms]≤ΔP/Δt≤35 [kPa/ms].

On the basis of the above results, when the transfer property is "bad" or the life span is "bad" regardless of the degree of the concave portion depth of the recording medium, "bad" is determined, and when the other cases are determined to be "acceptable," "good," or "excellent" according to a situation, "acceptable," "good," or "excellent" is determined when ΔP/Δt satisfies the condition of 10≤ΔP/Δt≤35.

Therefore, as can be understood from the above results, if the conveying speed is indicated by Vsys [mm/s], the maximum value of the pressing force is indicated by P [kPa], the width of the nip section of the transfer section is indicated by W [mm], the increase speed ΔP/Δt [kPa/ms] of the pressure in the nip section is indicated by ΔP/Δt=(P/2)×Vsys/(W/2)×1000, when the pressing force setting table is decided so that ΔP/Δt satisfies the condition of 10≤ΔP/Δt≤35, it is possible to implement the image forming device capable of achieving the high transfer property even for the recording medium having the concave-convex portions on the surface and suppressing degradation in the image grade by the repetitive use.

In the present embodiment, the example in which the present invention is applied to the image forming device including the belt showing the first pattern illustrated in FIG. 7 as the transfer belt has been specifically described, but the application scope of the present invention is not limited to this example and can be applied to the image forming device including the belt showing the second pattern illustrated in FIG. 8 as the transfer belt. In this case, the adhesion force reduction effect is not sufficiently obtained, but when the sufficiently large displacement of the surface of the transfer belt is secured by adjusting the pressing force in accordance with the conveying speed of the recording medium, it is possible to increase the follow-up deformation effect, and in this case, it is possible to implement the image forming device capable of achieving the high transfer property even for the recording medium having the concave-convex portions on the surface and suppressing degradation in the image grade by the repetitive use.

In the present embodiment, the example in which the present invention is applied to a so-called digital multifunction peripheral serving as an image forming device has been described, but it will be appreciated that the present invention can be applied to any other image forming device.

Although the present invention has been described and illustrated in detail, it is clearly understood that the same is by way of illustrated and example only and is not to be taken by way of limitation, the scope of the present invention being interpreted by terms of the appended claims. The scope of the present invention includes all modifications within the meaning and the scope equivalent to description of claims set forth below.

What is claimed is:

1. A transfer belt comprising:

at least an elastic layer, wherein the transfer belt is used to transfer a toner image onto a recording medium, the toner image being carried on a first main surface which is one of a pair of main exposed surfaces including the first main surface and a second main surface being positioned to face each other, when, using a lower block including a curved convex surface having a width of 20 [mm] and a curvature radius of 20 [mm] as an upper surface and a hole section having a diameter of 1.25 [mm] formed at an apex of the curved convex surface and an upper block including a curved concave surface having a width of 20 [mm] and a curvature radius of 20.3 [mm] as a lower surface, the transfer belt is placed on the upper surface of the lower block so that the first main surface faces the upper surface of the lower block, a part of the transfer belt is interposed between the curved convex surface and the curved concave surface by moving down the upper block toward the lower block, and a pressed region which is the part of the transfer belt reaches a pressing force of 200 [kPa] at a pressing speed of 4 [kPa/ms] and then is constantly pressed by a pressing force of 200 [kPa], if a maximum value of displacement of a measurement region which is a portion of the first main surface corresponding to the hole section is indicated by "a" [μm], and displacement of the measurement region after the displacement of the measurement region converges is indicated by "b" [μm], E [−] calculated by (a−b)/b using "a" and "b" satisfies a condition of $0.2 \leq E \leq 3$.

2. The transfer belt according to claim 1, wherein "b" further satisfies a condition of $4 \leq b \leq 8$.

3. The transfer belt according to claim 1, wherein when a period of time from a point in time at which pressing against the pressed region starts to a point in time at which the maximum value of the displacement of the measurement region is observed is indicated by t1 [s], and a period of time from the point in time at which the pressing against the pressed region starts to a point in time at which the displacement of the measurement region reaches (a+b)/2 again after the maximum value of the displacement of the measurement region is observed is indicated by t2 [s], k2 [μm/s] calculated by $(a-b)/\{2\times(t2-t1)\}$ using "a," "b," "t1," and "t2" further satisfies a condition of $6 \leq k2 \leq 30$.

4. The transfer belt according to claim 1, further comprising:

a base layer and a surface layer in addition to the elastic layer, wherein the elastic layer is formed to cover the base layer, the surface layer is further formed to cover the elastic layer, and the first main surface is defined by the surface layer.

5. An image forming device comprising:

an image carrier and an intermediate transfer belt each of which carries a toner image;

a primary transfer section that transfers the toner image carried on the image carrier onto the intermediate transfer belt; and a secondary transfer section that transfers the toner image carried on the intermediate transfer belt onto a recording medium, wherein the secondary transfer section includes a secondary transfer roller, an opposite roller opposed to the secondary transfer roller, and a nip section formed by the secondary transfer roller and the opposite roller, the intermediate transfer belt is arranged to pass through the nip section, and the transfer belt according to claim 1 is used as the intermediate transfer belt.

6. The image forming device according to claim 5, wherein the first main surface of the intermediate transfer belt is arranged to face the secondary transfer roller side, and hardness of a surface of the secondary transfer roller is higher than hardness of a surface of the opposite roller.

7. The image forming device according to claim 5, wherein the secondary transfer roller has a diameter of 20 [mm] to 60 [mm].

8. The image forming device according to claim 5, wherein maximum pressure in the nip section is 100 [kPa] or more and 400 [kPa] or less.

9. An image forming device comprising:

the transfer belt according to claim 1;

a transfer section that pinches and presses the transfer belt and a recording medium and transfers a toner image carried on the transfer belt onto the recording medium;

a fixing section that fixes the toner image transferred onto the recording medium onto the recording medium;

a conveying mechanism that conveys the recording medium from the transfer section to the fixing section;

a recording medium type information acquiring unit that acquires a recording medium type conveyed by the conveying mechanism;

a conveying speed setting unit that variably sets a conveying speed of the recording medium by the conveying mechanism;

a pressing force changing mechanism that changes pressing force to be applied to the transfer belt and the recording medium in the transfer section; and a control section that controls an operation of the pressing force changing mechanism such that the pressing force is adjusted in accordance with the recording medium type acquired by the recording medium type information acquiring unit and the conveying speed of the recording medium set by the conveying speed setting unit.

10. The image forming device according to claim 9 wherein the recording medium type information acquiring unit acquires the recording medium type on the basis of a concave portion depth of a surface of a recording medium.

11. The image forming device according to claim 9 wherein the control section controls the operation of the pressing force changing mechanism such that the pressing force increases as the conveying speed of the recording medium decreases.

12. The image forming device according to claim 9 further comprising:

a plurality of pressing force setting tables in which a relation between the recording medium type and the pressing force is decided in advance for each conveying speed, wherein the control section decides the pressing force with reference to the pressing force setting table according to the conveying speed from the plurality of pressing force setting tables.

13. The image forming device according to claim 9 further comprising:

a plurality of pressing force setting tables in which a relation between the conveying speed and the pressing force is decided in advance for each recording medium type, wherein the control section decides the pressing force with reference to the pressing force setting table according to the recording medium type from the plurality of pressing force setting tables.

14. The image forming device according to claim 9 wherein when the conveying speed is indicated by Vsys [mm/s], a maximum value of the pressing force is P [kPa], a width of a nip section of the transfer section is indicated by W [mm], an increase speed ΔP/Δt [kPa/ ms] of pressure in the nip section is indicated by $\Delta P/\Delta t=(P/2)\times Vsys/(W/2)\times 1000$, $\Delta P/\Delta t$ satisfies $10\leq\Delta P/\Delta t\leq 35$.

15. A transfer belt comprising:

at least an elastic layer, wherein the transfer belt is used to transfer a toner image onto a recording medium, the toner image being carried on a first main surface which is one of a pair of main exposed surfaces including the first main surface and a second main surface being positioned to face each other, when, using a lower block including a curved convex surface having a width of 20 [mm] and a curvature radius of 20 [mm] as an upper surface and a hole section having a diameter of 1.25 [mm] formed at an apex of the curved convex surface and an upper block including a curved concave surface having a width of 20 [mm] and a curvature radius of 20.3 [mm] as a lower surface, the transfer belt is placed on the upper surface of the lower block so that the first main surface faces the upper surface of the lower block, a part of the transfer belt is interposed between the curved convex surface and the curved concave surface by moving down the upper block toward the lower block, and a pressed region which is the part of the transfer belt reaches a pressing force of 200 [kPa] at a pressing speed of 4 [kPa/ms] and then is constantly pressed by a pressing force of 200 [kPa], if a maximum value of displacement of a measurement region which is a portion of the first main surface corresponding to the hole section is indicated by "a" [μm], and a period of time from a point in time at which pressing against the pressed region starts to a point in time at which the maximum value of the displacement of the measurement region is observed is indicated by t1 [s], k1 [μm/s] calculated by a/t1 using "a" and "k1" satisfies a condition of $60\leq k1\leq 320$.

16. The transfer belt according to claim 15, wherein when displacement of the measurement region after the displacement of the measurement region converges is indicated by "b" [μm], "b" satisfies a condition of $4\leq b\leq 8$.

17. The transfer belt according to claim 15, wherein when displacement of the measurement region after the displacement of the measurement region converges is indicated by "b" [μm], and a period of time from the point in time at which the pressing against the pressed region starts to a point in time at which the displacement of the measurement region reaches (a+b)/2 again after the maximum value of the displacement of the measurement region is observed is indicated by t2 [s], k2 [μm/s] calculated by $(a-b)/\{2\times(t2-t1)\}$ using "a," "b," "t1," and "t2" further satisfies a condition of $6\leq k2\leq 30$.

18. The transfer belt according to claim 15, further comprising:

a base layer and a surface layer in addition to the elastic layer, wherein the elastic layer is formed to cover the base layer, the surface layer is further formed to cover the elastic layer, and the first main surface is defined by the surface layer.

19. An image forming device comprising:

an image carrier and an intermediate transfer belt each of which carries a toner image;

a primary transfer section that transfers the toner image carried on the image carrier onto the intermediate transfer belt; and a secondary transfer section that transfers the toner image carried on the intermediate transfer belt onto a recording medium, wherein the secondary transfer section includes a secondary transfer roller, an opposite roller opposed to the secondary transfer roller, and a nip section formed by the secondary transfer roller and the opposite roller, the intermediate transfer belt is arranged to pass through the nip section, and the transfer belt according to claim 4 is used as the intermediate transfer belt.

* * * * *